US009885222B2

(12) United States Patent
Andrigo

(10) Patent No.: US 9,885,222 B2
(45) Date of Patent: Feb. 6, 2018

(54) STAGE TOOL APPARATUS AND COMPONENTS FOR SAME

(71) Applicant: Top-Co Cementing Products Inc., Weatherford, TX (US)

(72) Inventor: Gregory James Alexander Andrigo, Almonte (CA)

(73) Assignee: Top-Co Inc., Houston, TX (US)

( * ) Notice: Subject to any disclaimer, the term of this patent is extended or adjusted under 35 U.S.C. 154(b) by 464 days.

(21) Appl. No.: 14/172,073

(22) Filed: Feb. 4, 2014

(65) Prior Publication Data

US 2014/0224479 A1 Aug. 14, 2014

Related U.S. Application Data

(60) Provisional application No. 61/764,629, filed on Feb. 14, 2013.

(51) Int. Cl.

| | |
|---|---|
| ***E21B 23/08*** | (2006.01) |
| ***E21B 34/14*** | (2006.01) |
| ***E21B 33/16*** | (2006.01) |
| ***E21B 33/12*** | (2006.01) |
| ***E21B 34/06*** | (2006.01) |
| ***E21B 33/14*** | (2006.01) |
| ***E21B 29/00*** | (2006.01) |

(52) U.S. Cl.

CPC ..... *E21B 33/12* (2013.01); *E21B 29/00* (2013.01); *E21B 33/14* (2013.01); *E21B 33/146* (2013.01); *E21B 33/16* (2013.01); *E21B 34/06* (2013.01)

(58) Field of Classification Search

CPC ..... E21B 23/08; E21B 34/14; E21B 34/103; E21B 33/124; E21B 33/146; E21B 33/16

See application file for complete search history.

(56) References Cited

U.S. PATENT DOCUMENTS

| | | | |
|---|---|---|---|
| 3,485,298 | A | 12/1969 | Kisling, III |
| 3,550,683 | A | 12/1970 | Comeaux |
| 3,642,064 | A | 2/1972 | Rosenthal |
| 3,789,926 | A | 2/1974 | Henley et al. |
| 4,260,017 | A | 4/1981 | Nelson et al. |
| 4,487,263 | A | 12/1984 | Jani |
| 4,674,569 | A | 6/1987 | Revils et al. |
| 4,751,967 | A | 6/1988 | Blandford et al. |
| 4,836,279 | A | 6/1989 | Freeman |
| 5,368,098 | A | 11/1994 | Blizzard, Jr. et al. |
| 6,250,618 | B1 | 6/2001 | Greenhill |
| 6,279,659 | B1 | 8/2001 | Brunet |

(Continued)

FOREIGN PATENT DOCUMENTS

| | | | |
|---|---|---|---|
| CA | 2239748 | A1 | 12/1999 |
| WO | 94/15062 | A1 | 7/1994 |

OTHER PUBLICATIONS

European Patent Office; Communication pursuant to Article 94(3) EPC, dated Feb. 2, 2017 for EP Application No. 14 154 928.7; 8 pages; Rijswijk, NL.

(Continued)

*Primary Examiner* — Cathleen R Hutchins

(74) *Attorney, Agent, or Firm* — Reed & Scardino LLP

(57) ABSTRACT

A stage tool apparatus and components for same are described. In several exemplary embodiments, the stage tool apparatus is part of tubular string or casing positioned within a preexisting structure such as, for example, a wellbore.

11 Claims, 36 Drawing Sheets

(56) References Cited

U.S. PATENT DOCUMENTS

| | | | | |
|---|---|---|---|---|
| 2007/0267200 | A1 | 11/2007 | Jackson et al. | |
| 2008/0000697 | A1* | 1/2008 | Rytlewski | E21B 43/14 175/317 |
| 2011/0030975 | A1* | 2/2011 | Duphorne | E21B 23/006 166/386 |
| 2011/0079381 | A1* | 4/2011 | Cejero | E21B 21/103 166/73 |
| 2013/0213658 | A1* | 8/2013 | Makowiecki | B08B 9/0554 166/311 |

OTHER PUBLICATIONS

United States International Searching Authority; International Search Report, dated Nov. 26, 2010, for PCT/US2010/051612; 2 pages; Virginia, US.

United States International Searching Authority; Written Opinion; dated Nov. 26, 2010, for PCT/US2010/051612; 11 pages; Virginia, US.

* cited by examiner

STAGE TOOL APPARATUS AND COMPONENTS FOR SAME

CROSS-REFERENCE TO RELATED APPLICATION

This application claims the benefit of the filing date of, and priority to, U.S. Application No. 61/764,629, filed Feb. 14, 2013, the entire disclosure of which is incorporated herein by reference.

BACKGROUND

This disclosure relates in general to oil and gas exploration and production operations, and in particular to supporting a casing that extends within a wellbore, and isolating one or more formations through which the wellbore extends, to facilitate oil and gas exploration and production operations, including drill-out operations.

DETAILED DESCRIPTION

Figure 1:
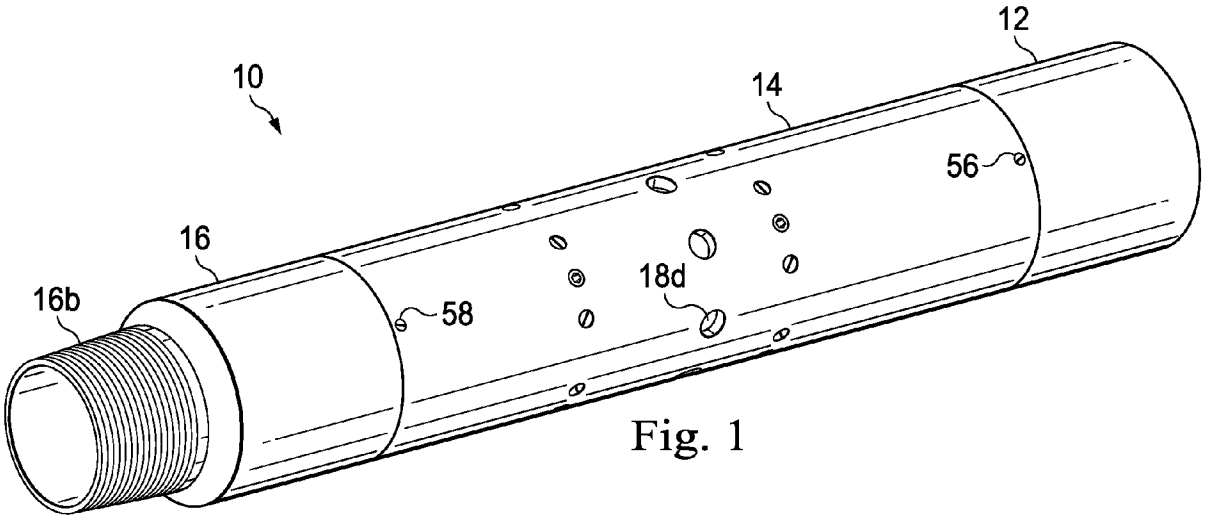
FIG. 1 is a perspective view of a stage tool apparatus according to an exemplary embodiment, the stage tool apparatus including a box sub, a body assembly and a pin sub.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the tool, or the apparatus, in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Figure 2:
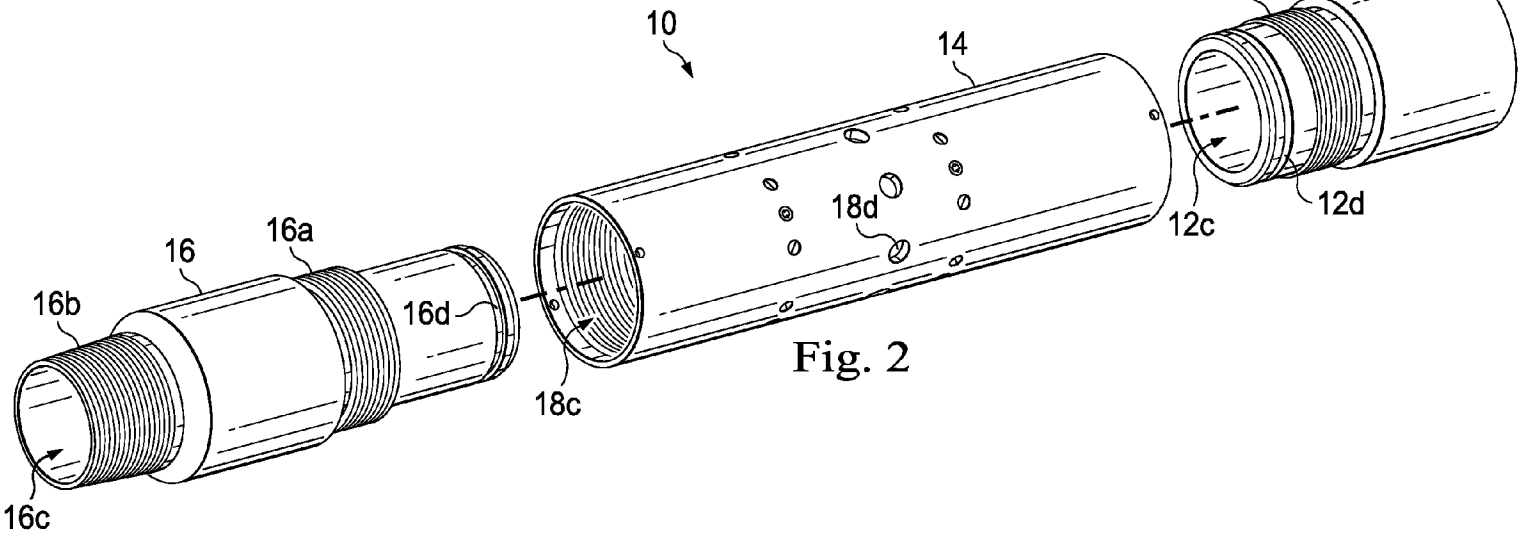
FIG. 2 is a partially exploded view of the stage tool apparatus of FIG. 1 according to an exemplary embodiment.
Figure 3:
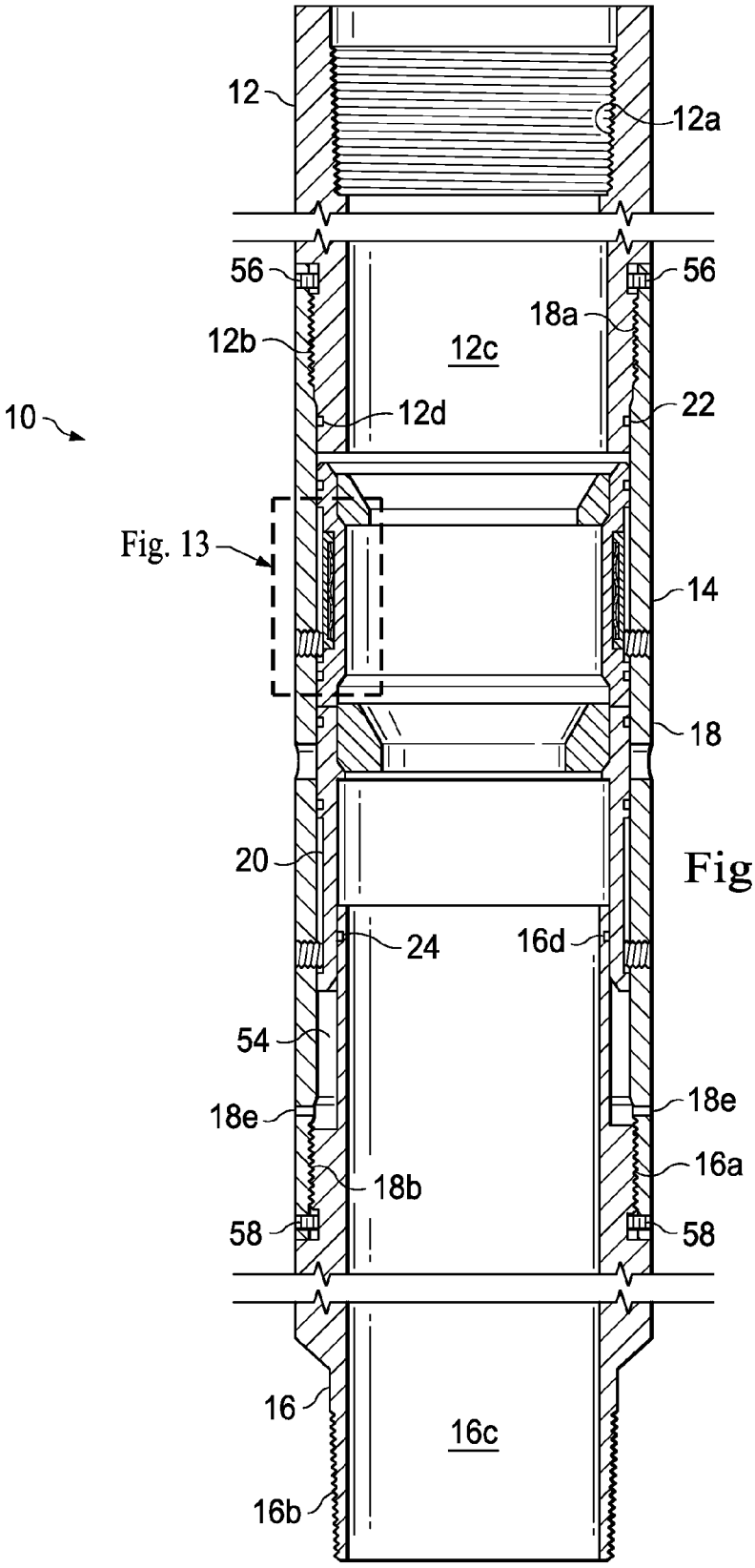
FIG. 3 is a sectional view of the stage tool apparatus of FIG. 1 according to an exemplary embodiment.
Figure 4:
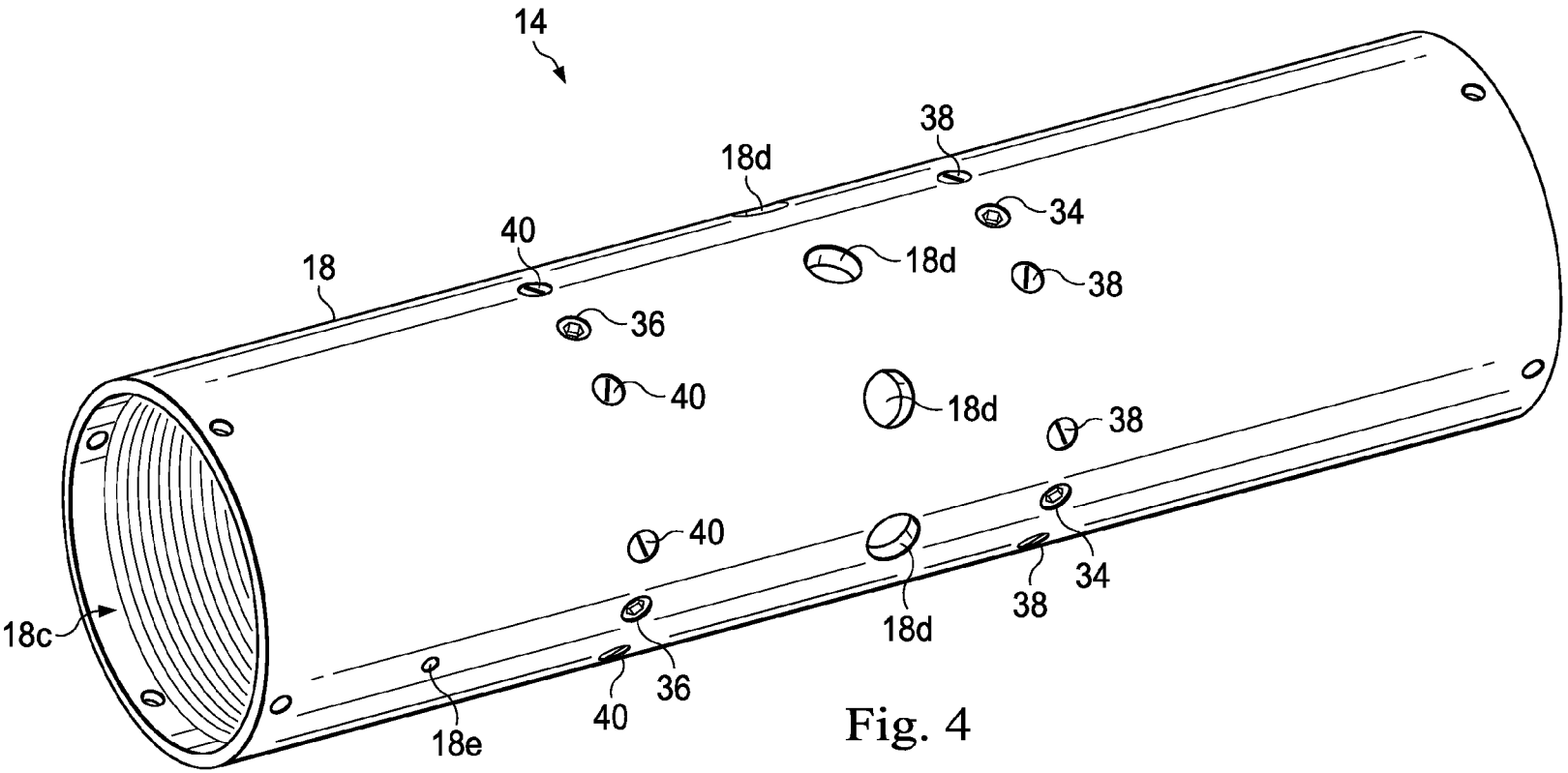
FIG. 4 is a perspective view of the body assembly of FIG. 1 according to an exemplary embodiment, the body assembly including an outer sleeve and a plurality of components engaged therewith or disposed therein.

In an exemplary embodiment, as illustrated in FIGS. 1-3, a downhole tool, and in particular a stage tool apparatus, is generally referred to by the reference numeral 10 and includes a box sub 12, a body assembly 14, and a pin sub 16. The box sub 12 includes an internal threaded connection 12*a* at one of its end portions, and an external threaded connection 12*b* that is axially spaced between the internal threaded connection 12*a* and the other of its end portions. The box sub 12 defines an internal passage 12*c*.

Even though FIG. 3 depicts the stage tool apparatus 10 in a vertical orientation associated with vertical wellbores, it should be understood by those skilled in the art that the apparatus according to the present disclosure is equally well suited for use in wellbores having other orientations including slanted wellbores, horizontal wellbores, multilateral wellbores or the like. Accordingly, it should be understood by those skilled in the art that the use of directional terms such as "above," "top," "below," "upper," "lower," "upward," "bottom," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction or top being toward the surface of the well, the downhole direction or bottom being toward the toe of the well.

The body assembly 14 includes an outer tubular member, such as an outer sleeve 18, and a plurality of components 20 engaged therewith or disposed therein, which components will be described in greater detail below. The outer sleeve 18 includes an internal threaded connection 18*a* at one of its end portions and an internal threaded connection 18*b* at the other of its end portions. The internal threaded connection 18*a* is coupled to the external threaded connection 12*b* of the box sub 12, thereby coupling the box sub 12 to the body assembly 14. The outer sleeve 18 defines an internal passage 18*c*. A sealing element, such as an o-ring 22, extends in an annular channel 12*d* formed in the outside surface of the box sub 12, the o-ring 22 sealingly engaging the inside surface of the outer sleeve 18.

The pin sub 16 includes an external threaded connection 16*a* at one end portion, which is coupled to the internal threaded connection 18*b* of the outer sleeve 18 of the body assembly 14, thereby coupling the pin sub 16 to the body assembly 14. The pin sub 16 further includes an external threaded connection 16*b* at the other end portion that is distal to the body assembly 14. The pin sub 16 defines an internal passage 16*c*. As shown in FIG. 3, a sealing element, such as an o-ring 24, extends in an annular channel 16*d* formed in the outside surface of the pin sub 16.

In an exemplary embodiment, as illustrated in FIGS. 4-9 with continuing reference to FIGS. 1-3, the outer sleeve 18 further includes a plurality of circumferentially-spaced flow ports 18*d*, each of which extends radially through the outer sleeve 18, and a plurality of circumferentially-spaced ports 18*e* spaced axially from the plurality of ports 18*d*, with each of the ports 18*e* also extending radially through the outer sleeve 18.

As noted above, the body assembly 14 includes a plurality of components 20 engaged with the outer sleeve 18 or disposed therein. The plurality of components 20 includes an upper tubular member such as an upper sleeve 26, a lower tubular member such as a lower sleeve 28, an upper seat 30, a lower seat 32, a plurality of components such as fasteners 34, a plurality of components such as fasteners 36, a plurality of shear screws 38, a plurality of shear screws 40, a plurality of springs 42, a plurality of lock keys 44, and sealing elements such as o-rings 46, 48, 50 and 52.

The upper sleeve 26 includes a plurality of axially-extending channels 26*a* formed in its outside surface, a circumferentially-extending shoulder 26*b* formed in its inside surface, and diametrically opposite arcuate notches 26*c* and 26*d* formed in one of its end portions. Each of the channels 26*a* includes an axially-extending channel or recess 26*aa* formed in a surface of the upper sleeve 26 defined by the channel 26*a*. The upper sleeve 26 defines an internal passage 26*e*.

The lower sleeve 28 includes a plurality of axially-extending channels 28*a* formed in its outside surface, a circumferentially-extending shoulder 28*b* formed in its inside surface, an arcuate notch 28*c* formed in a first end portion of the lower sleeve 28, and an arcuate notch (not shown) formed in the first end portion of the lower sleeve 28 and diametrically opposite the arcuate notch 28*c*. The lower sleeve 28 defines an internal passage 28*e*.

Figure 10:
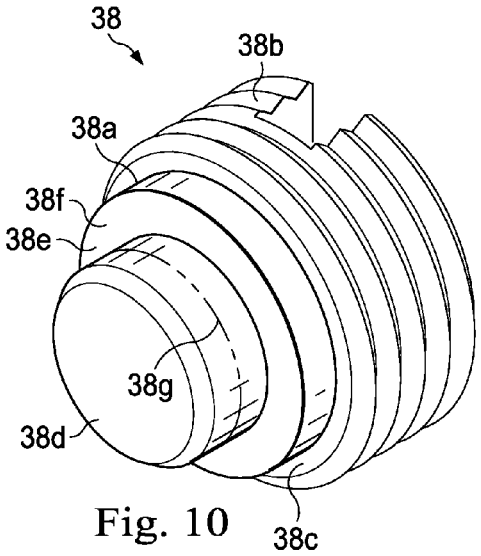
FIG. 10 is a perspective view of a shear screw according to an exemplary embodiment, the shear screw being one of the components shown in FIG. 6.

In an exemplary embodiment, as illustrated in FIG. 10 with continuing reference to FIGS. 1-9, each of the shear screws 38 includes a cylindrical body 38*a*, an external threaded connection 38*b* at one end portion of the cylindrical body 38*a*, a shoulder 38*c* formed in the cylindrical body 38*a* and adjacent the external threaded connection 38*b*, a generally cylindrical shear portion 38*d* extending from the other end portion of the cylindrical body 38*a*, and a shoulder 38*e* adjacent the proximal end of the generally cylindrical shear portion 38*d*, the shoulder 38*e* defining a flat 38*f*. One or more shear planes 38*g* extend through the generally cylindrical shear portion 38*d*, and are offset from, and generally parallel to, the flat 38*f*. Each of the one or more shear planes 38*g* is adapted to define the location at which at least a portion of the generally cylindrical shear portion 38*d* shears off from the remainder of the shear screw 38, under conditions to be described below.

The shear screws 40 are identical to the shear screws 38. Each of the shear screws 40 includes features that are identical to the features of each of the shear screws 38. Reference numerals used to refer to the features of the shear screws 40 that are identical to the features of the shear screws 38 will correspond to the reference numerals used to refer to the features of the shear screws 38 except that the prefix for the reference numerals used to refer to the features of the shear screws 38, that is, 38, will be replaced by the prefix of the shear screws 40, that is, 40.

Figure 11:
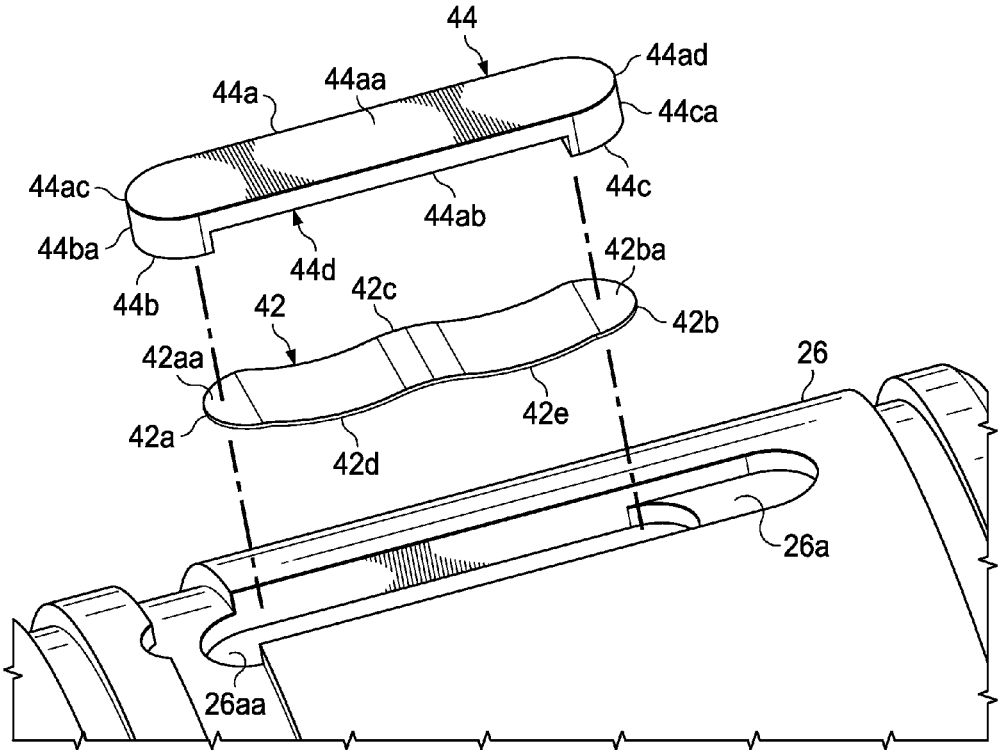
FIG. 11 is an enlarged view of a portion of FIG. 8 and illustrates a lock key and a spring according to respective exemplary embodiments.
Figure 12:
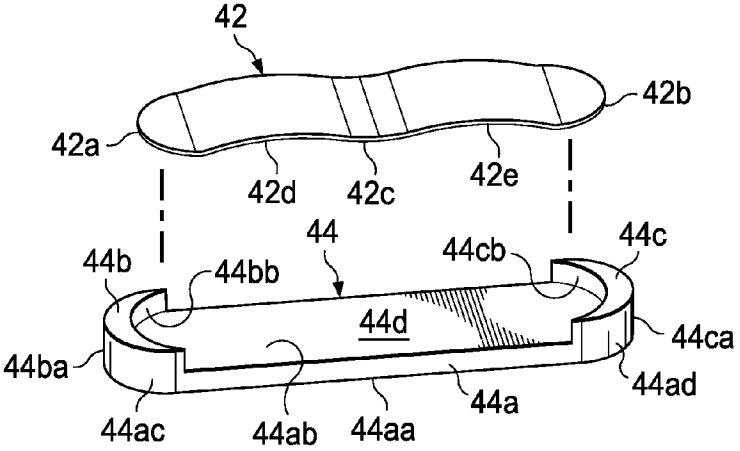
FIG. 12 is a perspective view of the lock key and the spring of FIG. 11.

In an exemplary embodiment, as illustrated in FIGS. 11 and 12 with continuing reference to FIGS. 1-10, each of the springs 42 includes opposing curved end portions 42*a* and 42*b* that define generally flat surfaces 42*aa* and 42*ba*, respectively, and a middle portion 42*c*. An arcuate portion 42*d* extends between the curved end portion 42*a* and the middle portion 42*c*. An arcuate portion 42*e* extends between the curved end portion 42*b* and the middle portion 42*c*.

Each of the lock keys 44 includes a bar member 44*a* defining sides 44*aa* and 44*ab* spaced in a parallel relation, and having opposing curved end portions 44*ac* and 44*ad*. Protrusions 44*b* and 44*c* extend from the side 44*ab* and include curved outer surfaces 44*ba* and 44*ca*, respectively, which are flush with the extents of the curved end portions 44*ac* and 44*ad*, respectively. The protrusions 44*b* and 44*c* further include facing curved inner surfaces 44*bb* and 44*cb*, respectively. An axially-extending region 44*d* is defined by the side 44*ab* and the curved inner surfaces 44*bb* and 44*cb*.

In an exemplary embodiment with continuing reference to FIGS. 1-12, when the stage tool apparatus 10 is in an assembled condition as illustrated in FIGS. 1 and 3, the external threaded connection 12*b* of the box sub 12 is threadably engaged with the internal threaded connection 18*a* of the outer sleeve 18, thereby coupling the box sub 12 to the outer sleeve 18. The o-ring 22 extends in the annular channel 12*d* formed in the outside surface of the box sub 12, and sealingly engages the inside surface of the outer sleeve 18. The external threaded connection 16*a* of the pin sub 16 is threadably engaged with the internal threaded connection 18*b* of the outer sleeve 18, thereby coupling the pin sub 16 to the outer sleeve 18. The o-ring 24 extends in the annular channel 16*d* formed in the outside surface of the pin sub 16, and sealingly engages an inside surface of the outer sleeve 18.

An annular region 54 (FIG. 3) is defined between the inside surface of the outer sleeve 18 and an outside surface of the end portion of the pin sub 16 that extends within the internal passage 18*c* of the outer sleeve 18. The annular region 54 is in fluid communication with the outside of the outer sleeve 18 and thus the apparatus 10 via the ports 18*e*. At least the lower end portion of the lower sleeve 28 extends within the annular region 54. A plurality of fasteners 56 extend through the outer sleeve 18 and into an annular channel formed in the outside surface of the box sub 12, thereby locking the box sub 12 to the outer sleeve 18. A plurality of fasteners 58 extend through the outer sleeve 18 and into an annular channel formed in the outside surface of the pin sub 16, thereby locking the pin sub 16 to the outer sleeve 18.

Figure 6:
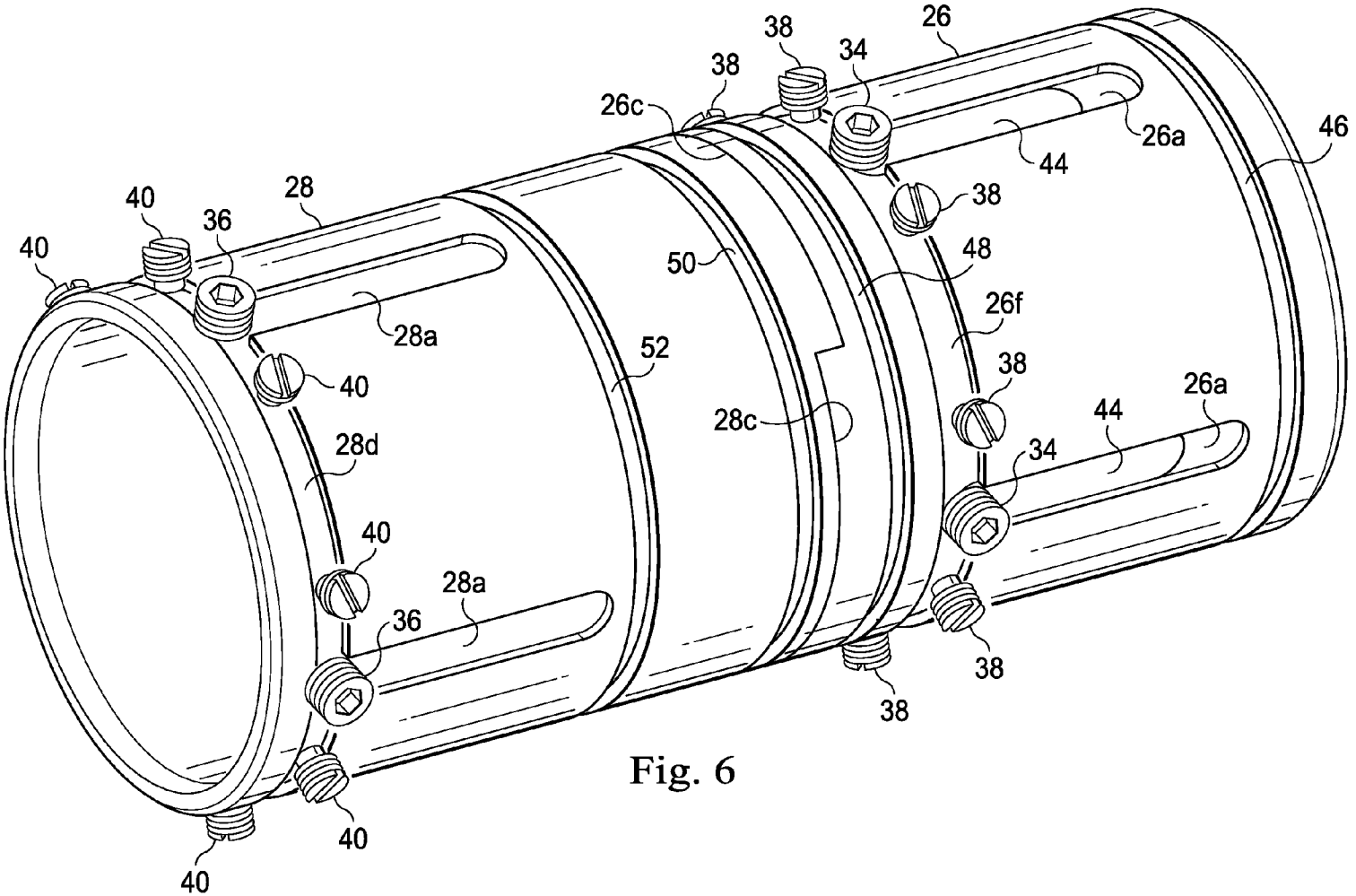
FIG. 6 is a perspective view of the plurality of components of FIGS. 4 and 5 according to an exemplary embodiment.
Figure 7:
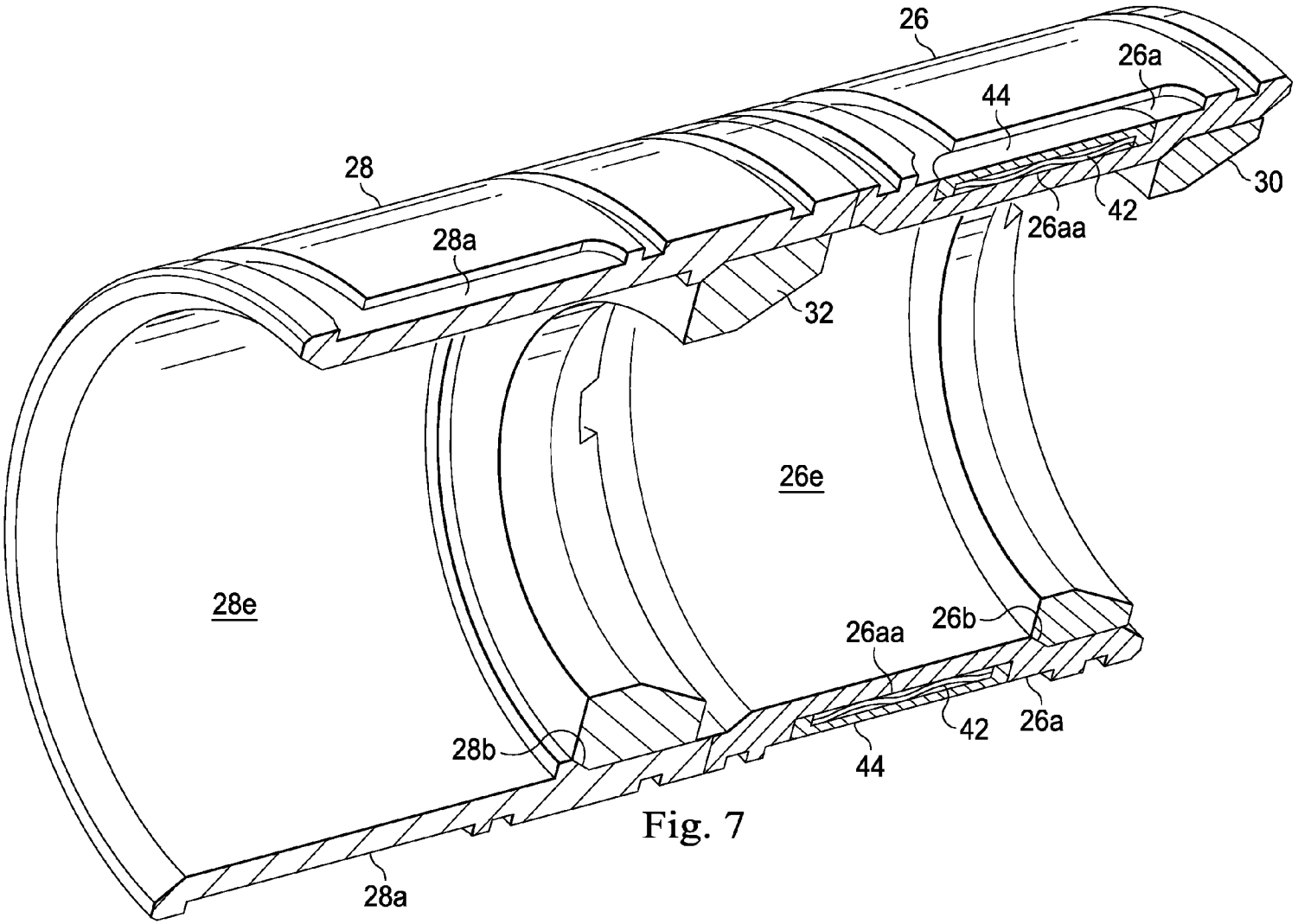
FIG. 7 is a perspective view of a section of a portion of the plurality of components of FIGS. 4-6 according to an exemplary embodiment.
Figure 8:
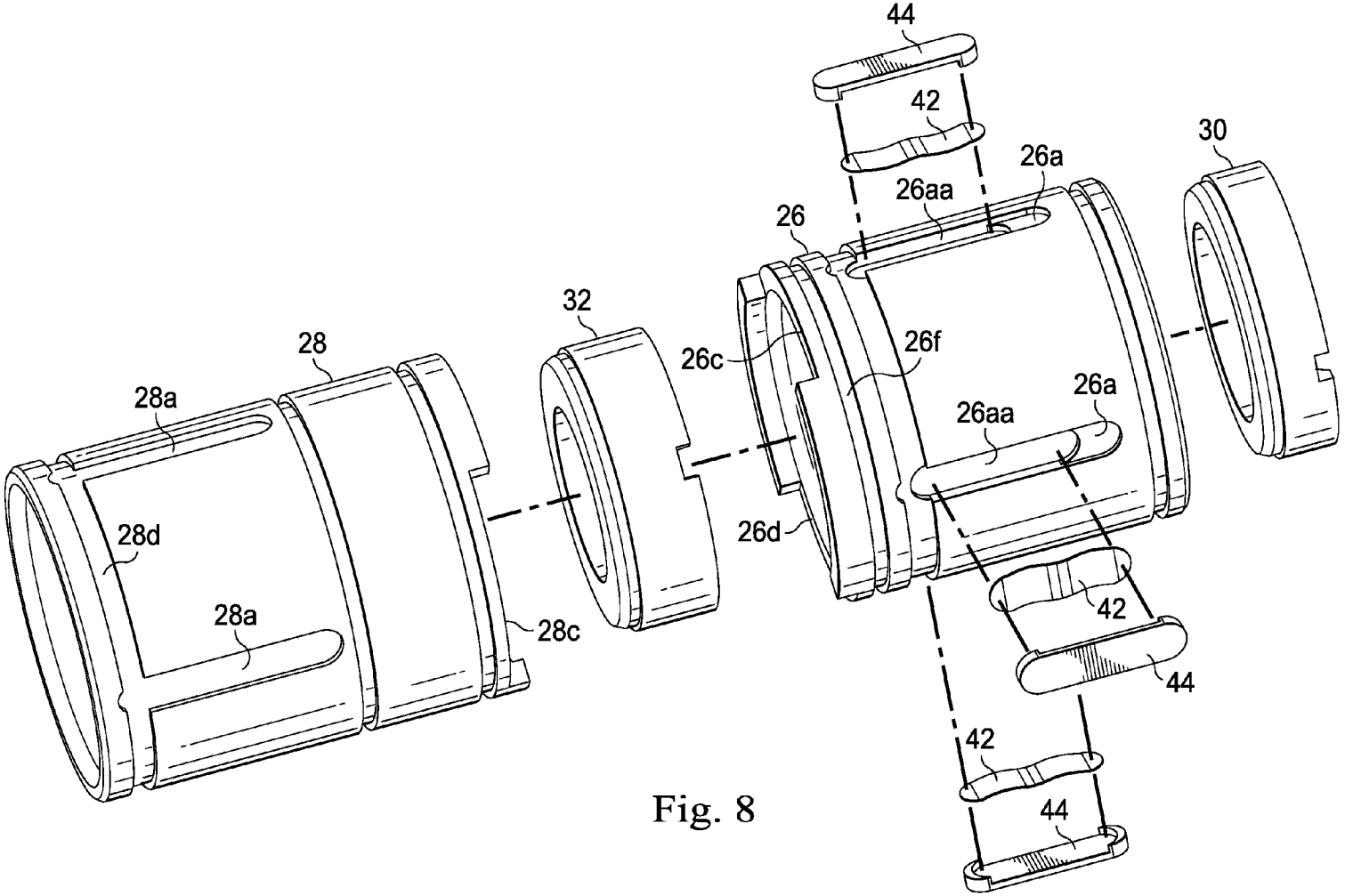
FIG. 8 is an exploded view of a portion of the plurality of components of FIGS. 4-7 according to an exemplary embodiment.
Figure 9:
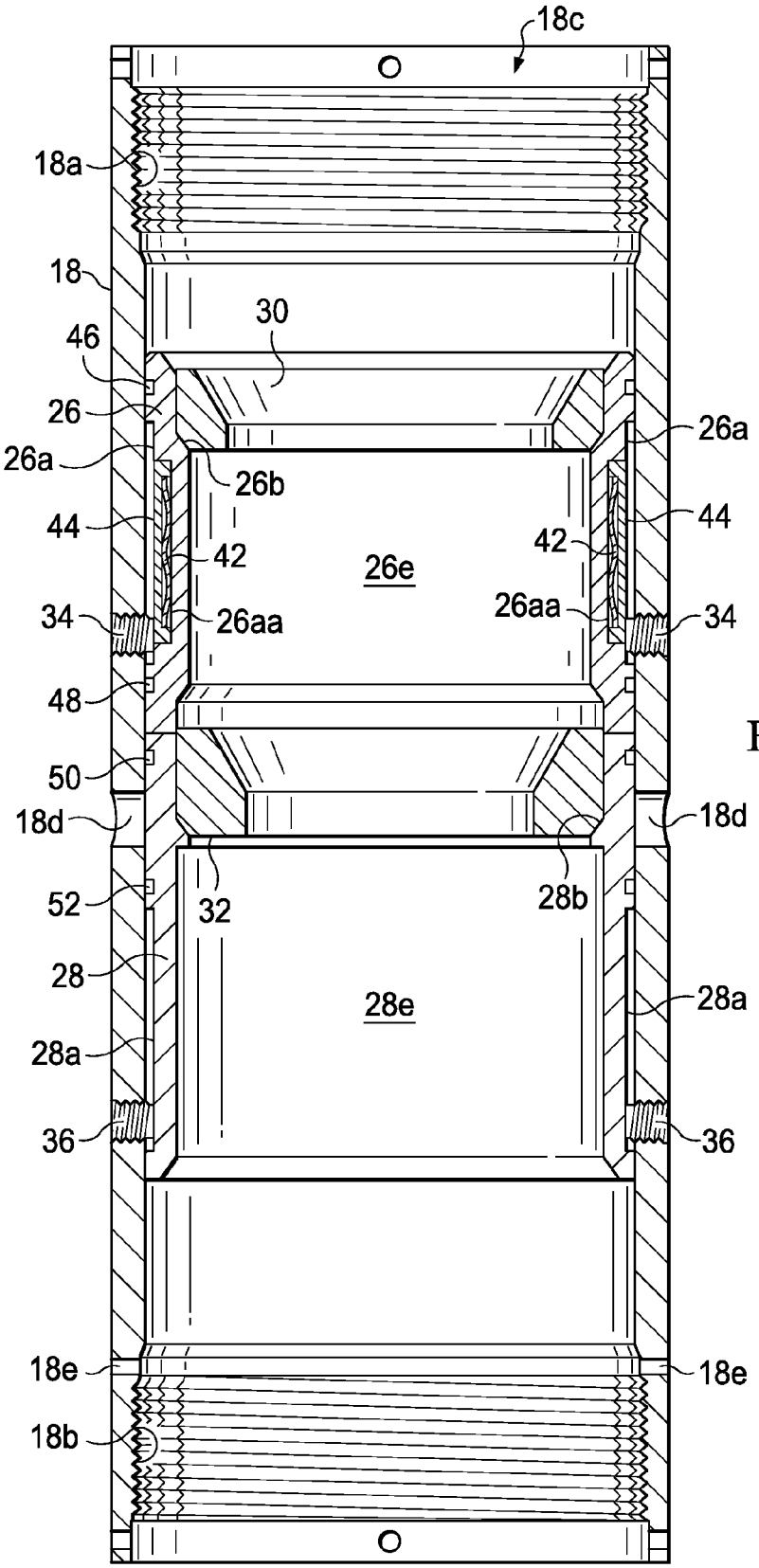
FIG. 9 is a sectional view of the body assembly of FIGS. 4 and 5 according to an exemplary embodiment.

The upper sleeve 26 extends within the internal passage 18*c* of the outer sleeve 18. The lower sleeve 28 also extends within the internal passage 18*c* of the outer sleeve 18. Within the internal passage 18*c*, the upper sleeve 26 is engaged with the lower sleeve 28 so that lower end portions of the upper sleeve 26 defined by the arcuate notches 26*c* and 26*d* are interposed between upper end portions of the lower sleeve 28 defined in part by the arcuate notch 28*c*, as shown in FIGS. 6 and 7. In an exemplary embodiment, axial gaps are defined between axially-facing end surfaces defined by the interposed lower end portions of the upper sleeve 26 and corresponding axially-facing end surfaces defined by the interposed upper end portions of the lower sleeve 28; in an exemplary embodiment, grease is disposed in the axial gaps to eliminate any metal-to-metal surface seal.

The upper seat 30 is disposed within the upper sleeve 26, engaging the shoulder 26*b* of the upper sleeve 26. The o-ring 46 sealingly engages the inside surface of the outer sleeve 18, and the o-ring 48, which is axially spaced from the o-ring 46, also sealingly engages the inside surface of the outer sleeve 18. As a result, the channels 26*a* and thus the recesses 26*aa* are fluidically isolated from the internal passages 12*c*, 16*c*, 18*c*, 26*e* and 28*e*. The shear screws 38 extend through the outer sleeve 18 and into an opening, such as an annular channel 26*f*, formed in the outside surface of the upper sleeve 26, thereby generally preventing relative axial movement between the upper sleeve 26 and the outer sleeve 18.

Figure 5:
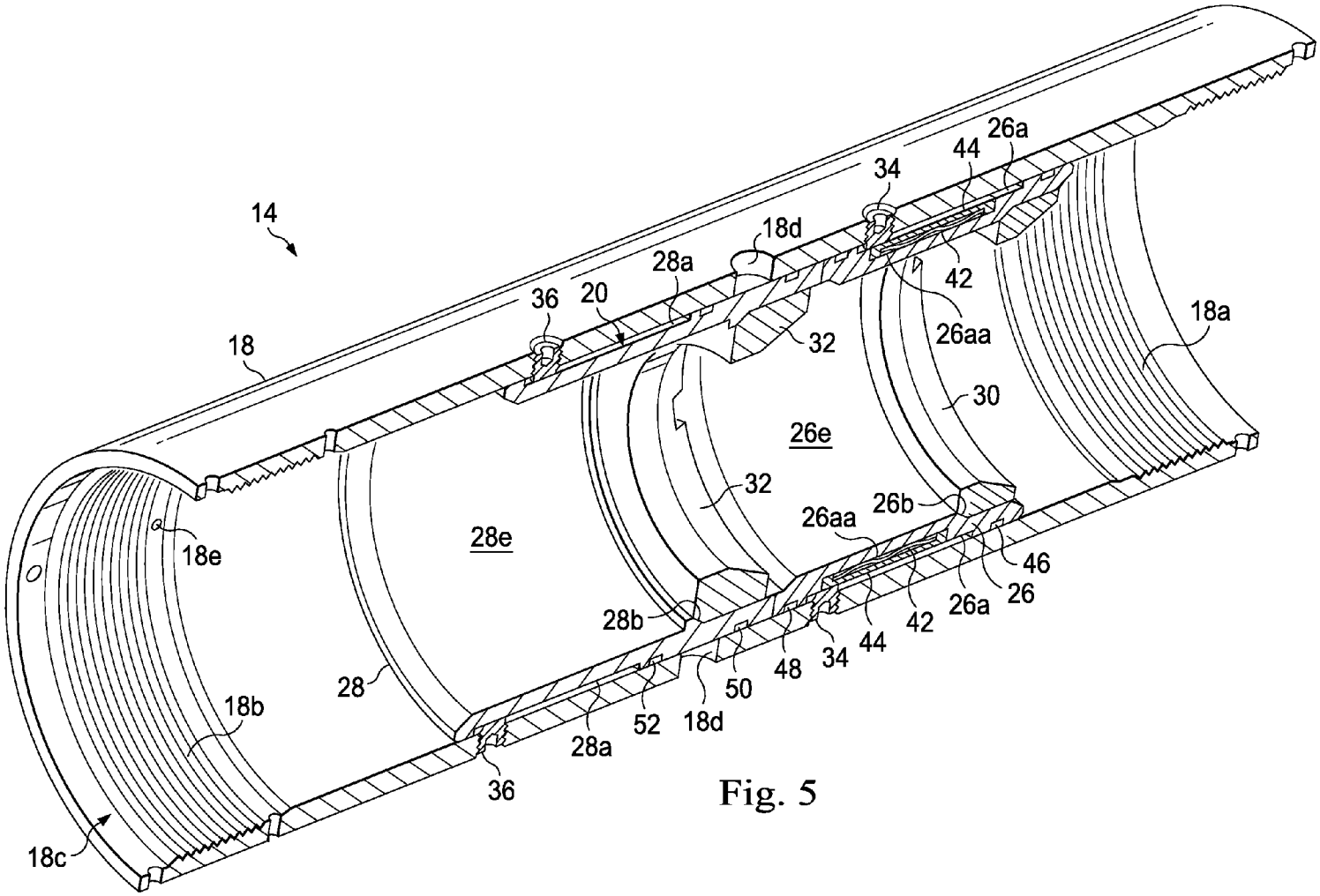
FIG. 5 is a perspective view of a section of the body assembly of FIG. 4 according to an exemplary embodiment, and depicts the outer sleeve and at least a portion of the plurality of components engaged therewith or disposed therein.

The lower seat 32 is disposed within the lower sleeve 28, engaging the shoulder 28*b* of the lower sleeve 28. Each of the fasteners 36 is coupled to the outer sleeve 18 and extends radially from the outer sleeve 18 and into a respective one of the channels 28*a* of the lower sleeve 28, thereby preventing or at least resisting relative rotation between the lower sleeve 28 and the outer sleeve 18. As shown in FIG. 5, the lower sleeve 28 blocks the ports 18*d*, the o-ring 50 sealingly engages the inside surface of the outer sleeve 18, and the o-ring 52, which is axially spaced from the o-ring 50, sealingly engages the inside surface of the outer sleeve 18. As a result, the ports 18*d* are fluidically isolated from the internal passages 12*c*, 16*c*, 18*c*, 26*e* and 28*e*. The shear screws 40 extend through the outer sleeve 18 and into an opening, such as an annular channel 28*d*, formed in the outside surface of the lower sleeve 28, thereby generally preventing or at least resisting relative axial movement between the lower sleeve 28 and the outer sleeve 18.

Figure 13:
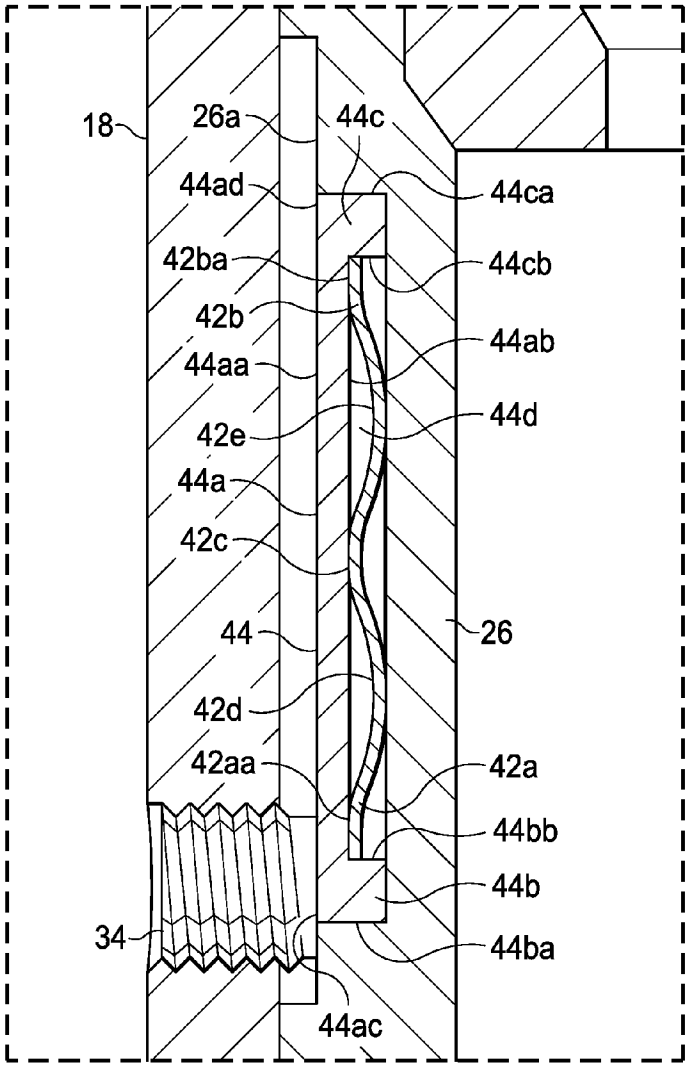
FIG. 13 is an enlarged view of a portion of FIG. 3.

In an exemplary embodiment, as illustrated in FIG. 13 with continuing reference to FIGS. 1-12, when the stage tool apparatus 10 is in an assembled condition as illustrated in FIGS. 1 and 3, each of the springs 42 is disposed in a respective one of the recesses 26*aa* of the upper sleeve 26. Each of the lock keys 44 is disposed in a respective one of the recesses 26*aa* so that the respective spring 42 is disposed radially between the upper sleeve 26 and the lock key 44, and is biased against the lock key 44 in an outwardly radial direction. At least one of the arcuate portions 42*d* and 42*e* of each spring 42 engages the vertically-extending surface of the sleeve 26 defined by the corresponding recess 26*aa*. For each of the springs 42 and its corresponding lock key 44, the opposing curved end portions 42*a* and 42*b* engage or nearly engage the curved inner surfaces 44*bb* and 44*cb*, respectively, the surfaces 42*aa* and 42*ba* engage the side 44*ab*, and the spring 42 extends within the region 44*d* of the corresponding lock key 44. Each of the fasteners 34 is coupled to the outer sleeve 18 and extends radially from the outer sleeve 18 and into a respective one of the channels 26*a* of the upper sleeve 26, thereby preventing or at least resisting relative rotation between the upper sleeve 26 and the outer sleeve 18. As shown in FIG. 13 and also in FIG. 5, each of the fasteners 34 engages at least the side 44*aa* of the corresponding lock key 44 at or proximate the curved end portion 44*ac*, thereby energizing the corresponding spring 42. More particularly, as a result of the engagements of the fasteners 34 with the sides 44*aa* of the respective lock keys 44, at least one of the arcuate portions 42*d* and 42*e* of each of the springs 42 is compressed between the vertically-extending surface of the sleeve 26 defined by the corresponding recess 26*aa* and the side 44*ab* of the corresponding lock key 44, thereby energizing the at least one of the arcuate portions 42*d* and 42*e* so that each of the springs 42 is energized and urges the corresponding lock key 44 radially outwards and out of the corresponding recess 26*aa*. However, the corresponding fastener 34 that is engaged with the side 44*aa* of the corresponding lock key 44 prevents or at least resists at least a portion of the lock key 44 from being pushed radially outwardly by the corresponding spring 42.

Figure 14:
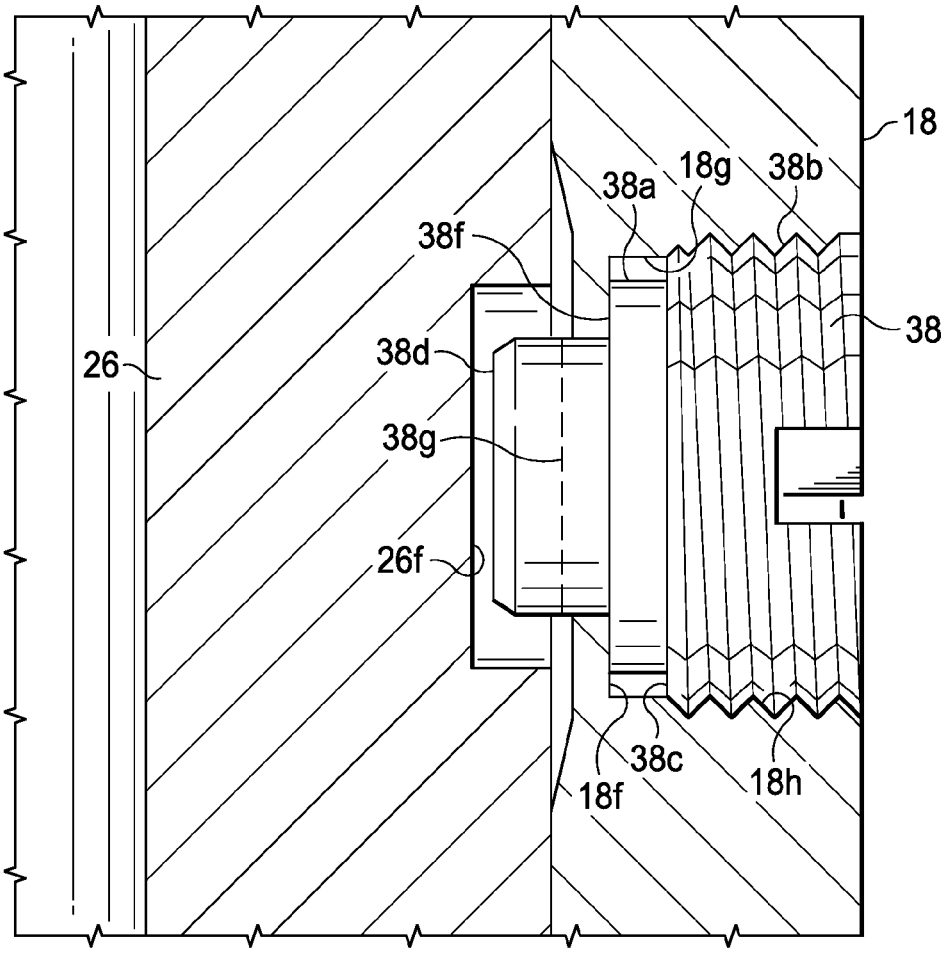
FIG. 14 is a partial sectional view of the shear screw of FIG. 10 extending through the outer sleeve of the body assembly of FIG. 4, according to an exemplary embodiment.

As noted above, the shear screws 38 extend through the outer sleeve 18 and into the annular channel 26*f* formed in the outside surface of the upper sleeve 26, thereby generally preventing or at least resisting relative axial movement between the upper sleeve 26 and the outer sleeve 18. In an exemplary embodiment, as illustrated in FIG. 14, each of the flats 38*f* engages a respective shoulder 18*f* of the outer sleeve 18 defined by, for example, a respective counterbore 18*g* in which the respective shear screw 38 is disposed, so that the shear screw 38 can be tightened up against the outer sleeve 18 for extra support, thereby preventing, or at least resisting, any twisting, slipping or stripping of the external threaded connection 38*b*. Each of the counterbores 18*g* includes an internal threaded connection 18*h* that is threadably engaged with the external threaded connection 38*b* of the respective shear screw 38. Likewise, as noted above, the shear screws 40 extend through the outer sleeve 18 and into the annular channel 28*d* formed in the outside surface of the lower sleeve 28, thereby generally preventing or at least resisting relative axial movement between the lower sleeve 28 and the outer sleeve 18. Each of the flats 40*f* engages a shoulder 18*i* (shown in FIG. 16*a*) of the outer sleeve 18 defined by, for example, a counterbore 18*j* (shown in FIG. 16*a*) in which the shear screw 40 is disposed, so that the shear screw 40 can be tightened up against the outer sleeve 18 for extra support, thereby preventing, or at least resisting, any twisting, slipping or stripping of the threaded connection 40*b*. Each of the counterbores 18*j* includes an internal threaded connection 18*k* (shown in FIG. 16*a*) that is threadably engaged with the external threaded connection 40*b* of the respective shear screw 40.

In several exemplary embodiments, the apparatus 10 or any component thereof includes, in whole or in part, one or more embodiments or portions thereof disclosed in U.S. patent application Ser. No. 12/898,444, filed Oct. 5, 2010, the entire disclosure of which is incorporated herein by reference.

In operation, in an exemplary embodiment, the apparatus 10 is initially in its assembled condition described above and is part of a tubular string or casing. A threaded end of a tubular support member (not shown) that defines an internal passage may be coupled to the internal threaded connection 12*a* of the box sub 12 so that the internal passage of the tubular support member is in fluid communication with the internal passage 12*c* of the box sub 12, the internal passage 18*c* of the outer sleeve 18, the internal passage 26*e* of the upper sleeve 26, the internal passage 28*e* of the lower sleeve 28, and the internal passage 16*c* of the pin sub 16. Similarly, a threaded end of another tubular member (not shown) that defines an internal passage may be coupled to the external threaded connection 16*b* of the pin sub 16 so that the internal passage of the other tubular support member is in fluid communication with the internal passage 12*c* of the box sub 12, the internal passage 18*c* of the outer sleeve 18, the internal passage 26*e* of the upper sleeve 26, the internal passage 28*e* of the lower sleeve 28, and the internal passage 16*c* of the pin sub 16.

Figure 15:
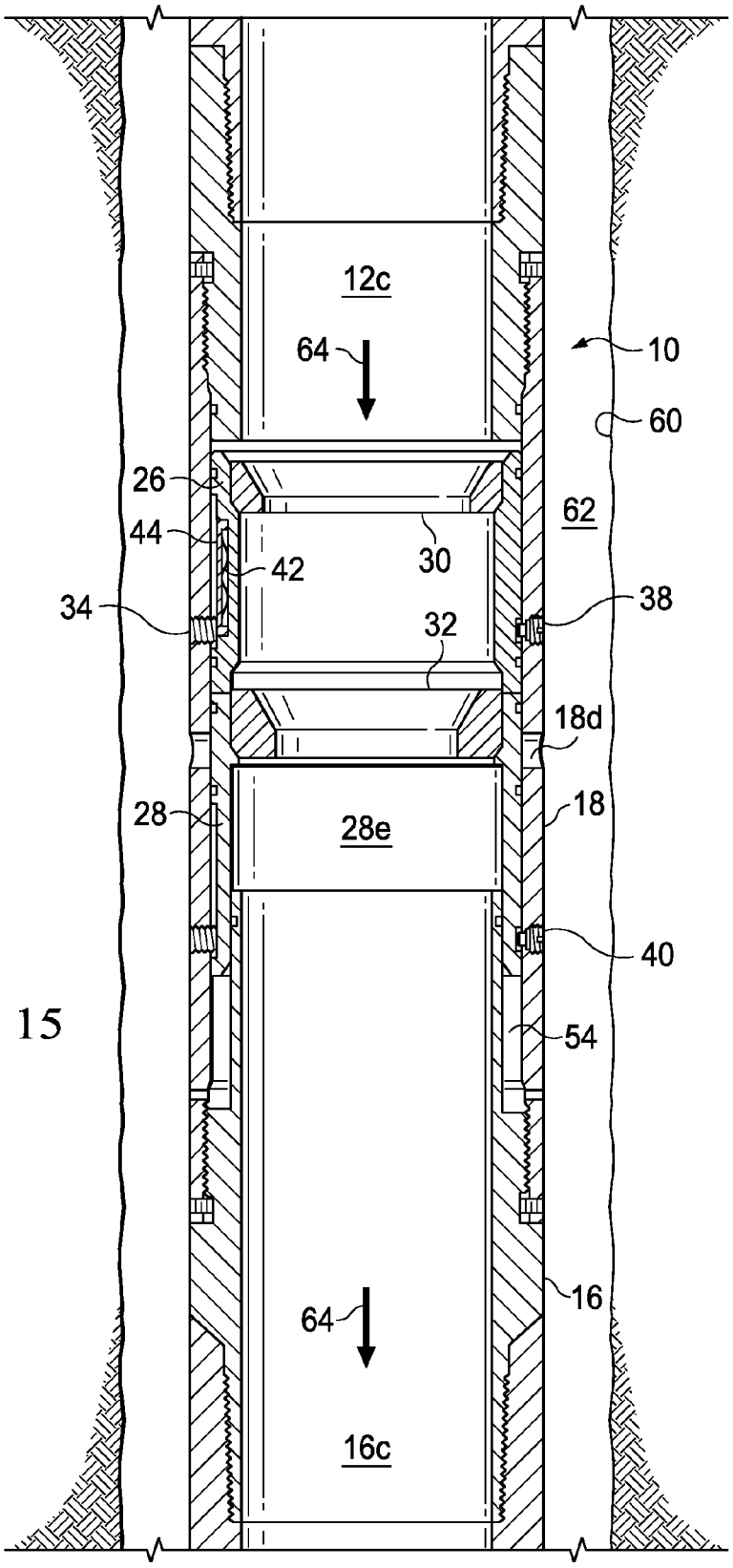
FIG. 15 is a partial sectional view of the stage tool apparatus of FIG. 1 extending within a wellbore and placed in an operational mode, according to an exemplary embodiment.

As illustrated in FIG. 15, the tubular string or casing of which the apparatus 10 is a part is positioned within a preexisting structure such as, for example, a wellbore 60 that traverses one or more subterranean formations, thereby defining an annular region 62 between the inside wall of the wellbore and the outside surface of the outer sleeve 18. As shown in FIG. 15, the apparatus 10 is in a neutral configuration, which generally corresponds to the assembled condition described above in which, inter alia, the lower sleeve 28 blocks the ports 18*d*, which are fluidically isolated from the internal passages 12*c*, 16*c*, 18*c*, 26*e* and 28*e*. As a result, the annular region 62 is fluidically isolated from the internal passages 12*c*, 16*c*, 18*c*, 26*e* and 28*e*.

In an exemplary embodiment, during or after the positioning of the apparatus 10 within the wellbore 60, fluidic materials 64 are injected into and circulated through the apparatus 10 via the internal passage 12*c*, the internal passage 18*c*, the internal passage 26*e*, the internal passage 28*e*, and the internal passage 16*c*. In an exemplary embodiment, the fluidic materials 64 may be circulated through and out of the tubular string or casing of which the apparatus 10 is a part and into the wellbore 60. In several exemplary embodiments, the fluidic materials 64 may include drilling fluids, drilling mud, water, other types of fluidic materials, or any combination thereof.

Figure 16:
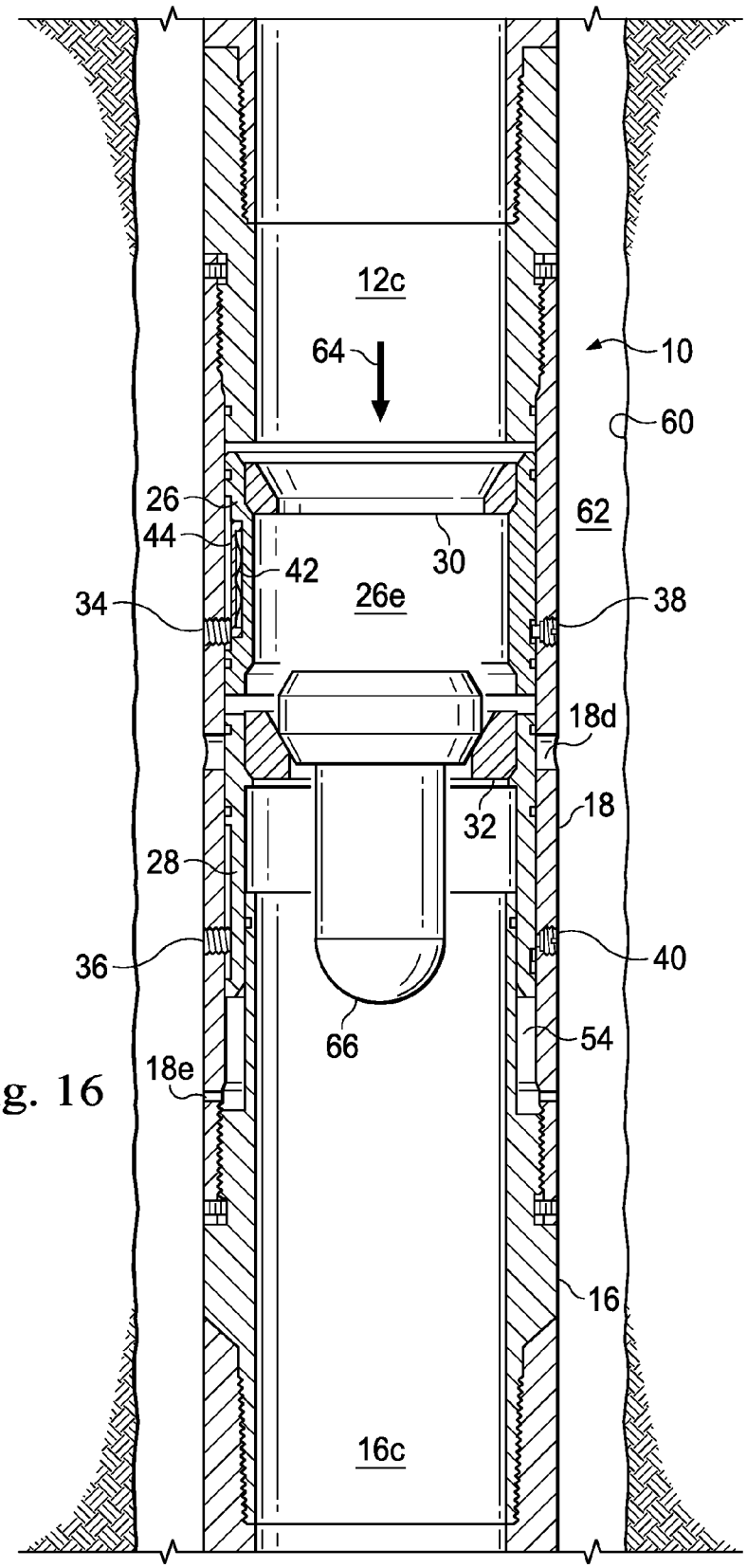
FIG. 16 is a partial sectional view of the stage tool apparatus of FIG. 1 extending within a wellbore and placed in an operational mode similar to that of FIG. 15, but also including a dart seated within the apparatus, according to an exemplary embodiment.

As illustrated in FIG. 16, a blocking element such as, for example, a dart 66, is injected into the apparatus 10 through at least the passage 12*c* and the internal passage 26*e* defined by the upper sleeve 26 until the dart 66 is seated in the lower seat 32. As a result, the flow of any fluidic materials, including the fluidic materials 64, through the lower sleeve 28 and therebelow is blocked.

Continued injection of the fluidic materials 64 into the apparatus 10, following the seating of the dart 66 in the lower seat 32, pressurizes the tubular string, of which the apparatus 10 is a part, above the dart 66. As a result, the dart 66, the lower seat 32 and the lower sleeve 28 are urged downward, relative to at least the outer sleeve 18 and the shear screws 40, so that a radially-extending surface 28*f* of the lower sleeve 28 that is defined by the annular channel 28*d* bears against the shear portions 40*d* of the respective shear screws 40. Continued injection of the fluidic materials 64 into the apparatus 10, following the surface 28*f* initially bearing against the shear portions 40*d*, causes the respective shear portions 40*d* of the shear screws 40 to shear, at which point the dart 66, the lower seat 32 and the lower sleeve 28 move downward, as viewed in FIG. 16, relative to the upper sleeve 26 and the outer sleeve 18 of the apparatus 10.

Figure 16A:
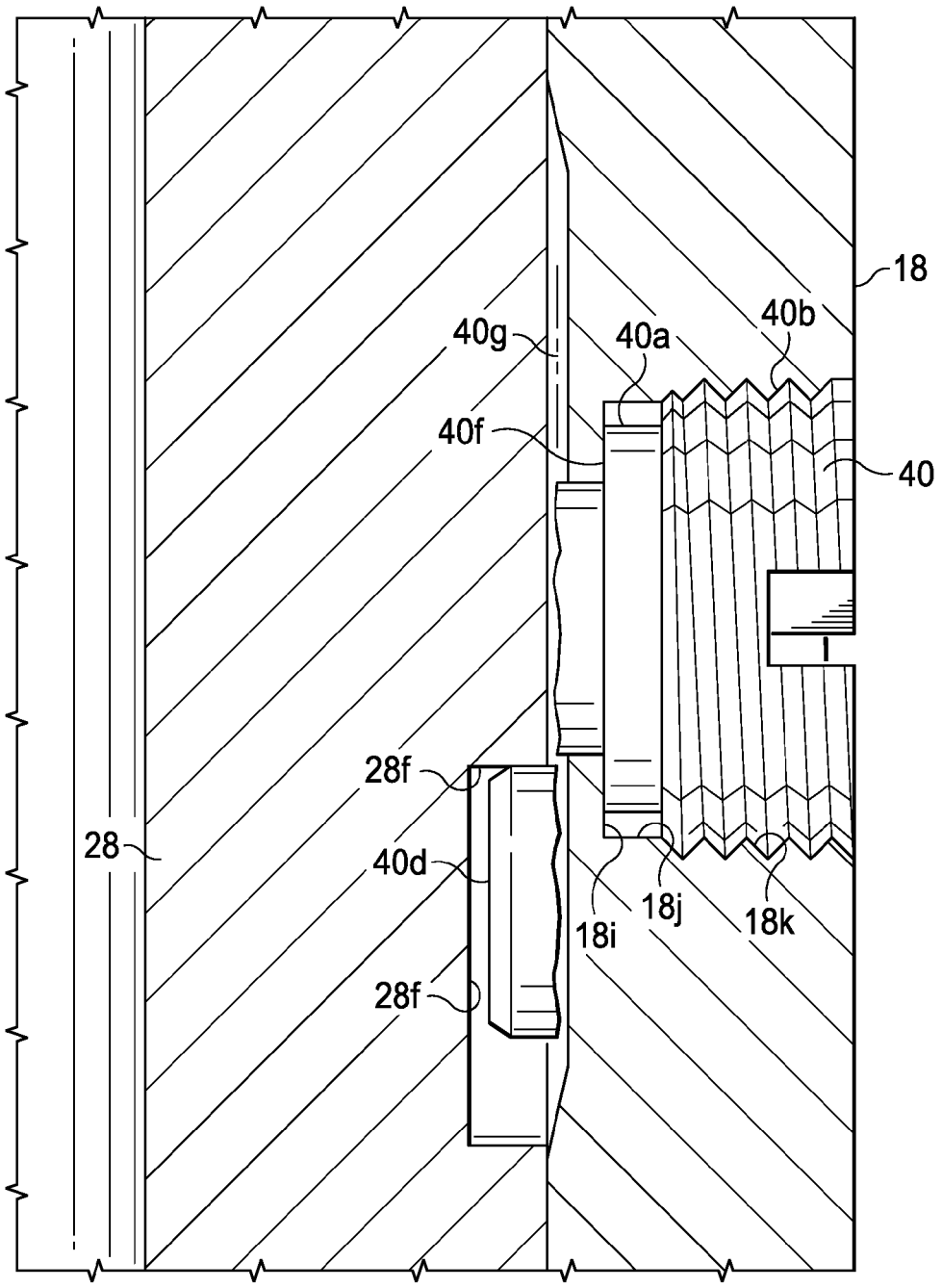
FIG. 16*a* is a partial sectional view of a shear screw when the stage tool apparatus of FIG. 1 is in the operational mode of FIG. 16, according to an exemplary embodiment.

As illustrated in FIG. 16*a*, each of the shear portions 40*d* shears along the respective shear plane 40*g*. Since the shear plane 40*g* is offset from, and generally parallel to, the flat 40*f* that is tightened against and engages the surface 18*i* of the outer sleeve 18, or since the shear plane 40*g* extends through the shear portion 40*d* rather than through, for example, the external threaded connection 40*b*, a cleaner shear along the shear plane 40*g* is achieved.

During the downward movement of the dart 66, the lower seat 32 and the lower sleeve 28, the channels 28*a* of the lower sleeve 28 move relative to the fasteners 36. As a result of the extension of the fasteners 36 into the respective channels 28*a*, the fasteners 36 guide the lower sleeve 28 as it moves downward, continuing to prevent or at least resist any relative rotation between the lower sleeve 28 and the outer sleeve 18. During the downward movement of the dart 66, the lower seat 32 and the lower sleeve 28, the lower end of the lower sleeve 28 is further received by the annular region 54.

Figure 17:
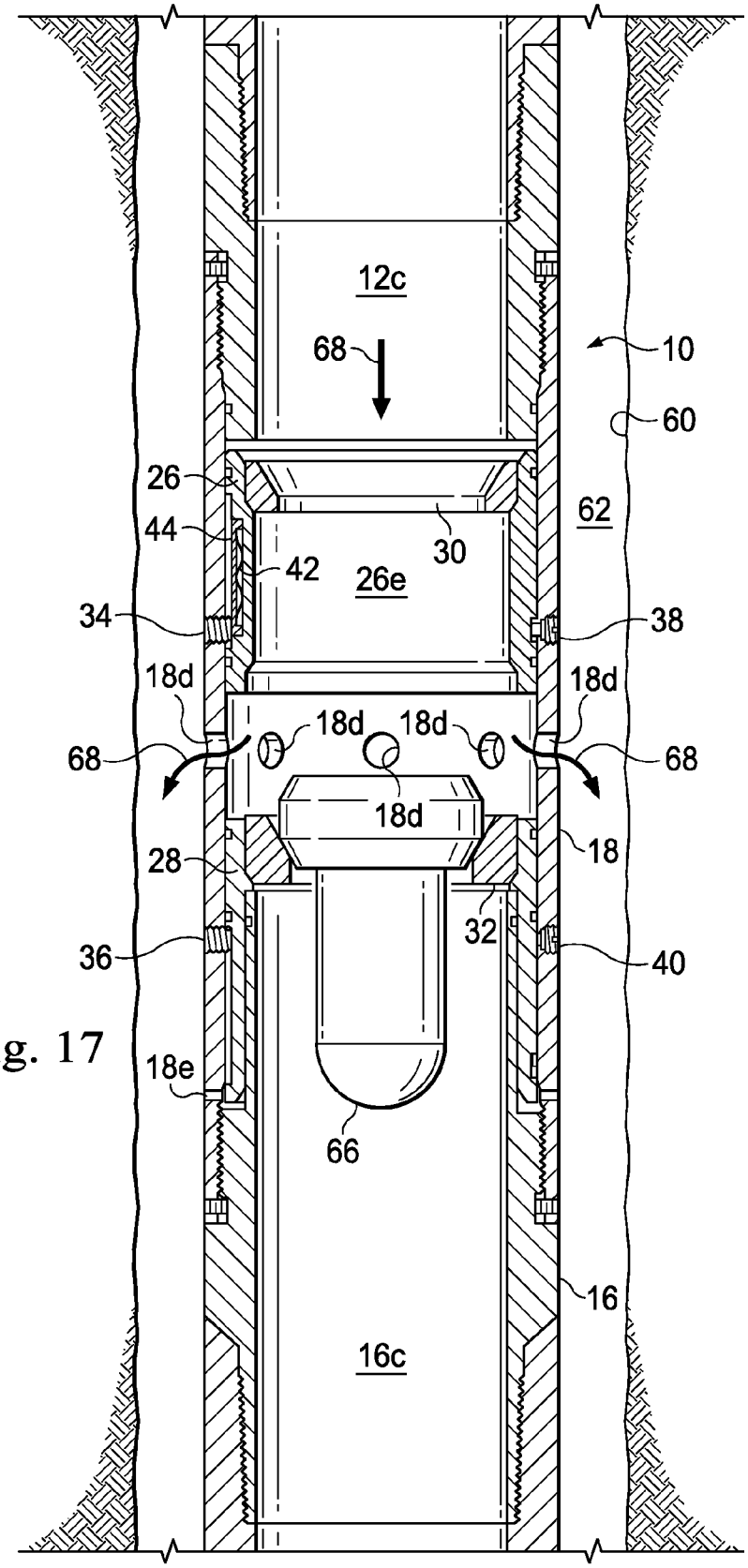
FIG. 17 is a partial sectional view of the stage tool apparatus of FIG. 1 extending within a wellbore and placed in an operational mode, according to an exemplary embodiment.

As illustrated in FIG. 17, the dart 66, the lower seat 32 and the lower sleeve 28 continue to move downward until the fasteners 36 engage the surfaces of the lower sleeve 28 defined by the upper ends of the respective channels 28*a*. As a result of these engagements, the lower sleeve 28 and thus the dart 66 and the lower seat 32 are prevented from moving any further downward. As a result of the downward movement of the dart 66, the lower seat 32 and the lower sleeve 28, the apparatus 10 is in an open configuration in which the ports 18*d* are not blocked by any of the upper sleeve 26 and the lower sleeve 28 and thus the annular region 62 is in fluid communication with at least the internal passage 12*c*, the internal passage 26*e* defined by the upper sleeve 26, and the internal passage 18*c* via the ports 18*d*.

In an exemplary embodiment, instead of placing the apparatus 10 in the open configuration mechanically via the engagement between the dart 66 and the lower seat 32 and the subsequent downward movement of the dart 66, the lower seat 32 and the lower sleeve 28, the apparatus 10 is placed in the open configuration hydraulically by pressurizing the tubular string of which the apparatus 10 is a part, and controlling the respective pressures within one or more of the wellbore 60, the annular region 62, and the tubular string including the apparatus 10, so that a differential pressure is created between the pressure applied against, inter alia, at least the lower seat 32 and the upper portion of the lower sleeve 28, and the pressure within the annular region 54. This differential pressure is increased by, for example, increasing the pressure applied against, inter alia, at least the lower seat 32 and the upper portion of the lower sleeve 28, so that the shear screws 40 are sheared and thus the lower seat 32 and the lower sleeve 28 move downward, as viewed in FIG. 17. The lower sleeve 28 moves downward in the annular region 54 with hydraulic lock being prevented by the ports 18*e*, via which the annular region 54 is in fluid communication with the annular region 62. In several exemplary embodiments, the ports 18*e* are bleed holes that prevent hydraulic lock.

With continuing reference to FIG. 17, before, during or after the downward movement of the lower seat 32 and the lower sleeve 28 (and the dart 66 if the apparatus 10 is placed in the open configuration mechanically), a fluidic material, such as a hardenable fluidic material 68, is injected into the apparatus 10 via the tubular string of which the apparatus 10 is a part, and into the internal passage 12*c*, the internal passage defined by the upper sleeve 26, and the internal passage 18*c*. The hardenable fluidic material 68 flows out of the apparatus 10 through the ports 18*d* of the outer sleeve 18 and into the annular region 62. As a result, an annular body of the hardenable fluidic material 68 is formed within the annular region 62. After the curing of the annular body of the hardenable fluidic material 68 within the annular region 62, the apparatus 10 and the tubular string of which the apparatus 10 is a part is better supported within the wellbore 60, and the portion of the annular region 62 or any formation below the annular body of the hardenable fluidic material 68 is fluidically isolated from the portion of the annular region 62 or any formation above the annular body of the hardenable fluidic material 68. In several exemplary embodiments, the improved support of the apparatus 10 or the tubular string of which the apparatus 10 is a part, or the fluidic isolation of the portion of the annular region 62 or any formation above the annular body of the hardenable fluidic material 68 from the portion of the annular region 62 or the any formation below the annular body, facilitate oil and gas exploration or production operations subsequent to the operation of the apparatus 10, as described above and below. In an exemplary embodiment, the hardenable fluidic material 68 is, or includes, cement. In an exemplary embodiment, the hardenable fluidic material 68 is, or includes, cement, and the completion of forming (and subsequently curing) the annular body of the material 68 is the completion of one stage in the stage cementing of the tubular string or casing of which the apparatus 10 is a part in the wellbore 60.

Figure 18:
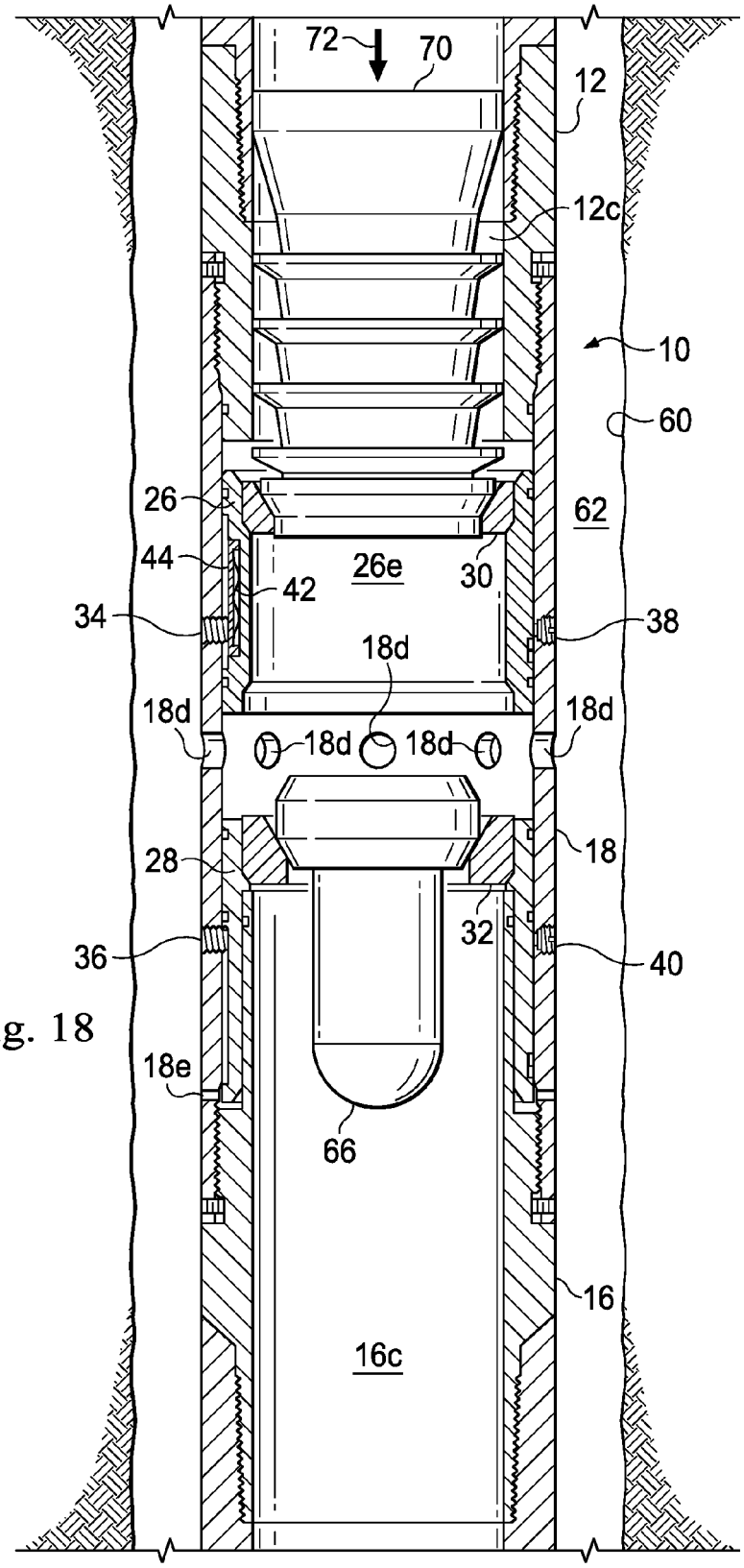
FIG. 18 is a partial sectional view of the stage tool apparatus of FIG. 1 extending within a wellbore and placed in an operational mode similar to that of FIG. 17, but also including a plug seated within the apparatus, according to an exemplary embodiment.

As illustrated in FIG. 18, before, during or after the curing of the annular body of the hardenable fluidic material 68, a blocking element such as, for example, a plug 70, is injected into the apparatus 10 through at least the passage 12*c*, until the plug 70 is seated in the upper seat 30. As a result, the flow of any fluidic materials through the upper sleeve 26 and the remainder of the apparatus 10 therebelow is blocked. Fluidic materials 72 are injected into the apparatus 10, following the seating of the plug 70 in the upper seat 30, thereby pressurizing the tubular string of which the apparatus 10 is a part. Continued injection of the fluidic materials 72 causes the respective shear portions 38*d* of the shear screws 38 to shear, at which point the plug 70, the upper seat 30 and the upper sleeve 26 move downward, as viewed in FIG. 18, relative to the outer sleeve 18 and the lower sleeve 28 of the apparatus 10. Each of the shear portions 38*d* shears along the respective shear plane 38*g*. Since the shear plane 38*g* is offset from, and generally parallel to, the flat 38*f* that is tightened against and engages the surface 18*f* of the outer sleeve 18, or since the shear plane 38*g* extends through the shear portion 38*d* rather than through, for example, the external threaded connection 38*b*, a cleaner shear along the shear plane 38*g* is achieved. During the downward movement of the plug 70, the upper seat 30, and the upper sleeve 26, the channels 26*a* of the upper sleeve 26, the springs 42, and the lock keys 44 move relative to the fasteners 34. As a result of the extension of the fasteners 34 into the respective channels 26*a*, the fasteners 34 guide the upper sleeve 28 as it moves downward, continuing to prevent or at least resist any relative rotation between the upper sleeve 26 and the outer sleeve 18.

Figure 18A:
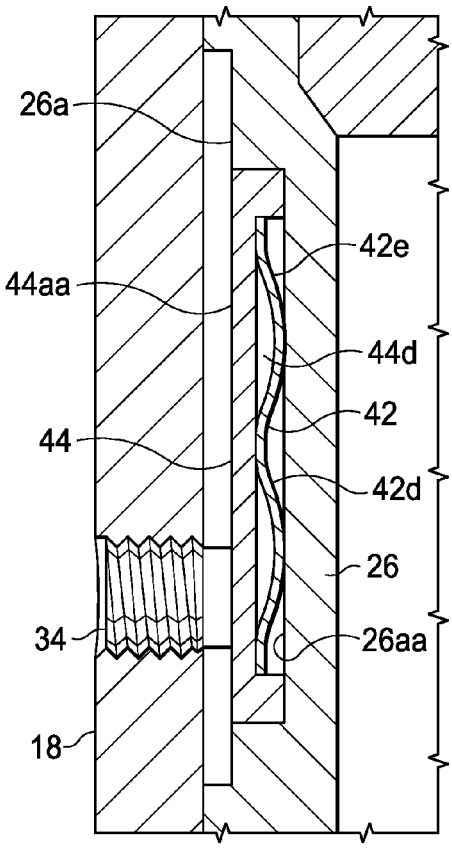
FIG. 18*a* is a view similar to that of FIG. 13, but depicting the portion shown in FIG. 13 when the stage tool apparatus of FIG. 1 is in the operational mode of FIG. 18, according to an exemplary embodiment.

As illustrated in FIG. 18*a*, during the downward movement of the upper sleeve 26, each of the lock keys 44 slides against the corresponding fastener 34, and conversely each of the fasteners 34 continues to engage the side 44*aa* of the corresponding lock key 44, thereby continuing to energize the corresponding spring 42. Since each of the fasteners 34 initially engages the side 44*aa* of the corresponding lock key 44 (as shown in FIG. 13), the lock key 44 moves relative to, and slides against, the fastener 34, and conversely the fastener 34 continues to engage the side 44*aa* of the lock key 44 during this relative movement, as shown in FIG. 18*a*.

Figure 19A:
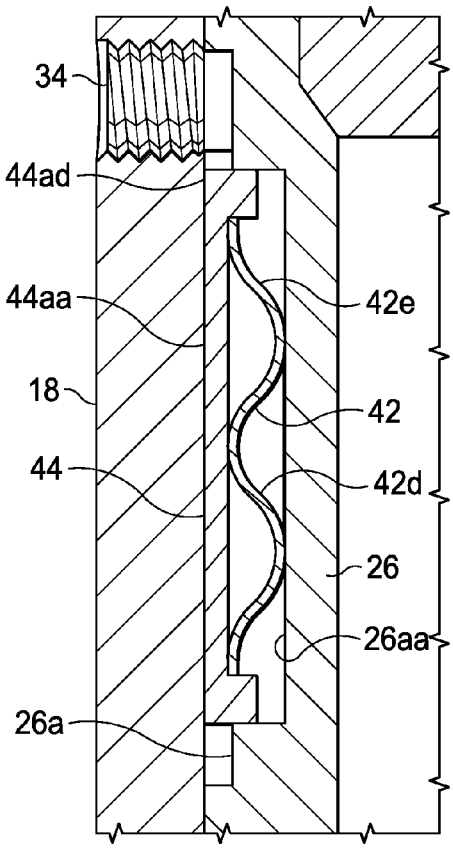
FIG. 19*a* is a view similar to that of FIG. 18*a*, but depicting the portion shown in FIG. 18*a* when the stage tool apparatus of FIG. 1 is in the operational mode of FIG. 19, according to an exemplary embodiment.
Figure 19:
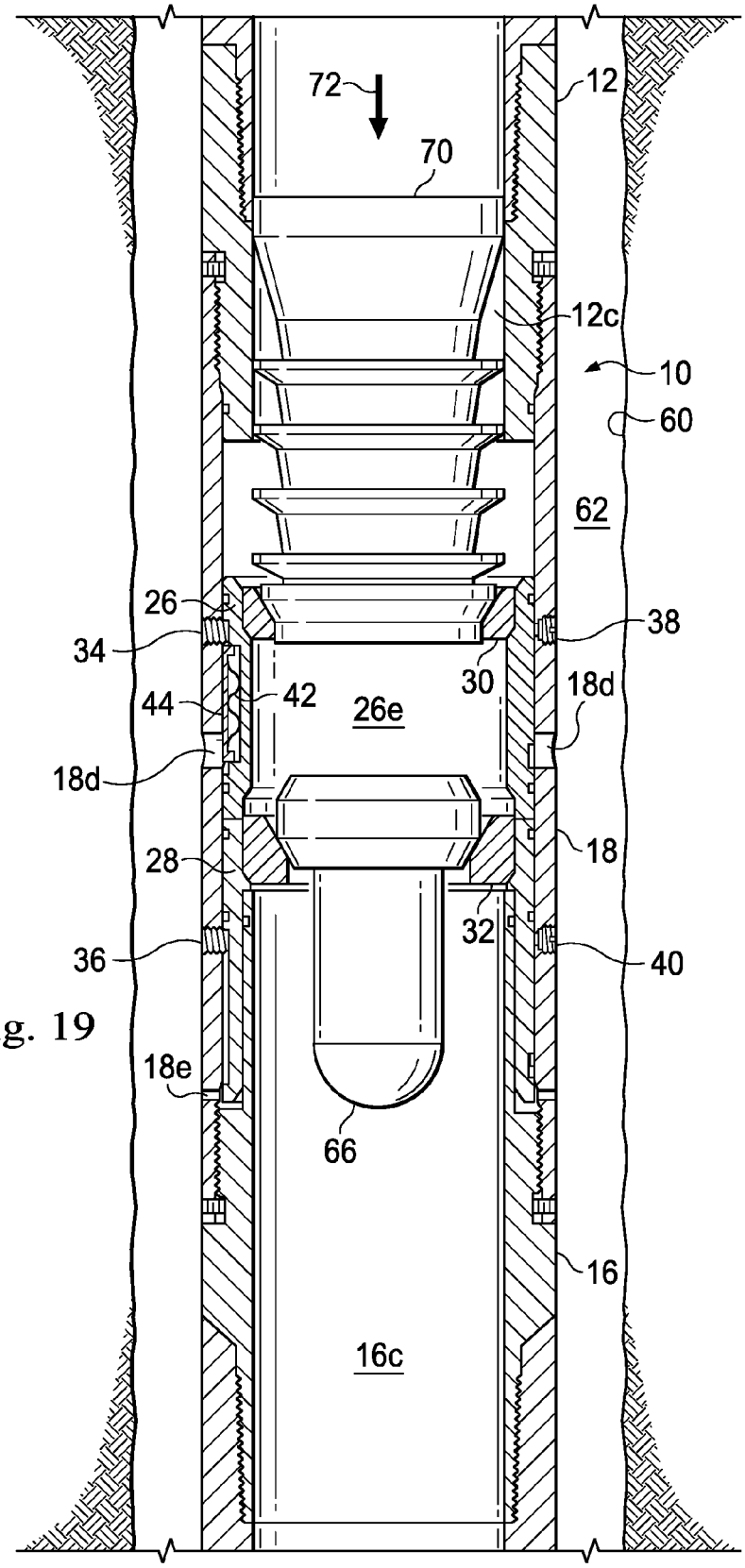
FIG. 19 is a partial sectional view of the stage tool apparatus of FIG. 1 extending within a wellbore and placed in an operational mode, according to an exemplary embodiment.

As illustrated in FIGS. 19 and 19*a*, the plug 70, the upper seat 30 and the upper sleeve 26 continue to move downward until the fasteners 34 engage the surfaces of the upper sleeve 26 defined by the upper ends of the respective channels 26*a* (shown in FIG. 19*a*). As a result of these engagements, the upper sleeve 26 and thus the plug 70 and the upper seat 30 are prevented from moving any further downward. As a result of this downward movement of the plug 70, the upper seat 30 and the upper sleeve 26, the apparatus 10 is in a closed configuration in which the ports 18*d* are blocked by the upper sleeve 26 and thus the annular region 62 is fluidically isolated from at least the internal passage 26*e* defined by the upper sleeve 26. As another result of this downward movement of the plug 70, the upper seat 30 and the upper sleeve 26, each of the fasteners 34 is no longer engaging the side 44*aa* of the bar member 44*a* of the respective lock key 44. As a result, the springs 42 sufficiently relax to push the respective lock keys 44 radially outward within the respective channels 26*a*.

As a result of the radially outward movement of the lock keys 44, the lock keys 44 are radially positioned so that each fastener 34 is axially disposed between a surface of the upper sleeve 26 defined by the upper end of the respective channel 26*a* and at least the end portion 44*ad* of the respective lock key 44, as shown in FIG. 19*a*. Moreover, each fastener 34 continues to be circumferentially disposed between the vertically-extending side walls of the upper sleeve 26 that are defined by the respective channel 26*a*. As a result, the upper sleeve 26 is jammed; the upper sleeve 26 cannot appreciably translate or rotate relative to the lower sleeve 28 or the outer sleeve 18.

The jammed upper sleeve 26 prevents any appreciable upward movement of the lower sleeve 28, as viewed in FIG. 19, and the respective engagements between the fasteners 36 and the surfaces of the lower sleeve 28 defined by the upper ends of the respective channels 28*a* prevent any downward movement of the lower sleeve 28, as viewed in FIG. 19. Moreover, each fastener 36 continues to be circumferentially disposed between the vertically-extending side walls of the lower sleeve 28 that are defined by the respective channel 28*a*. As a result, the lower sleeve 28 is jammed; the lower sleeve 28 is not permitted to appreciably translate or rotate relative to the upper sleeve 26 or the outer sleeve 18. Since neither the upper sleeve 26 nor the lower sleeve 28 is permitted to appreciably rotate or translate relative to each other or the outer sleeve 18, the apparatus 10 is thus locked in the closed configuration illustrated in FIG. 19. This locking of the upper sleeve 26 and the lower sleeve 28 facilitates any drill-out operation of the upper seat 30 and the lower seat 32.

As yet another result of the above-described downward movement of the upper sleeve 26, the upper sleeve 26 is engaged with the lower sleeve 28 so that lower end portions of the upper sleeve 26 defined by the arcuate notches 26*c* and 26*d* are again interposed between upper end portions of the lower sleeve 28 defined in part by the arcuate notch 28*c*; and axial gaps are defined between axially-facing end surfaces defined by the interposed lower end portions of the upper sleeve 26 and corresponding axially-facing end surfaces defined by the interposed upper end portions of the lower sleeve 28; in an exemplary embodiment, grease is disposed in the axial gaps to eliminate any metal-to-metal surface seal.

In an exemplary embodiment, after the apparatus 10 has been placed in the closed configuration illustrated in FIG. 19, a drill-out operation occurs during which at least the upper seat 30 and the lower seat 32 are drilled out. As noted above, the locking of the upper sleeve 26 and the lower sleeve 28 in the closed configuration illustrated in FIG. 19 assists in the drill-out operation by preventing the upper sleeve 26 and the lower sleeve 28 from appreciably translating or rotating within the outer sleeve 18 during the drill-out operation. In an exemplary embodiment, after the apparatus 10 has been placed in the closed configuration illustrated in FIG. 19, a drill-out operation occurs during which at least the plug 70, the upper seat 30, the dart 66 and the lower seat 32 are drilled out. As noted above, the locking of the upper sleeve 26 and the lower sleeve 28 in the closed configuration illustrated in FIG. 19 assists in the drill-out operation by preventing the upper sleeve 26 and the lower sleeve 28 from appreciably translating or rotating within the outer sleeve 18 during the drill-out operation.

In several exemplary embodiments, one or more additional stage tool apparatuses, each of which is substantially similar to the apparatus 10, are part of the tubular string or casing of which the apparatus 10 is a part.

Figure 20:
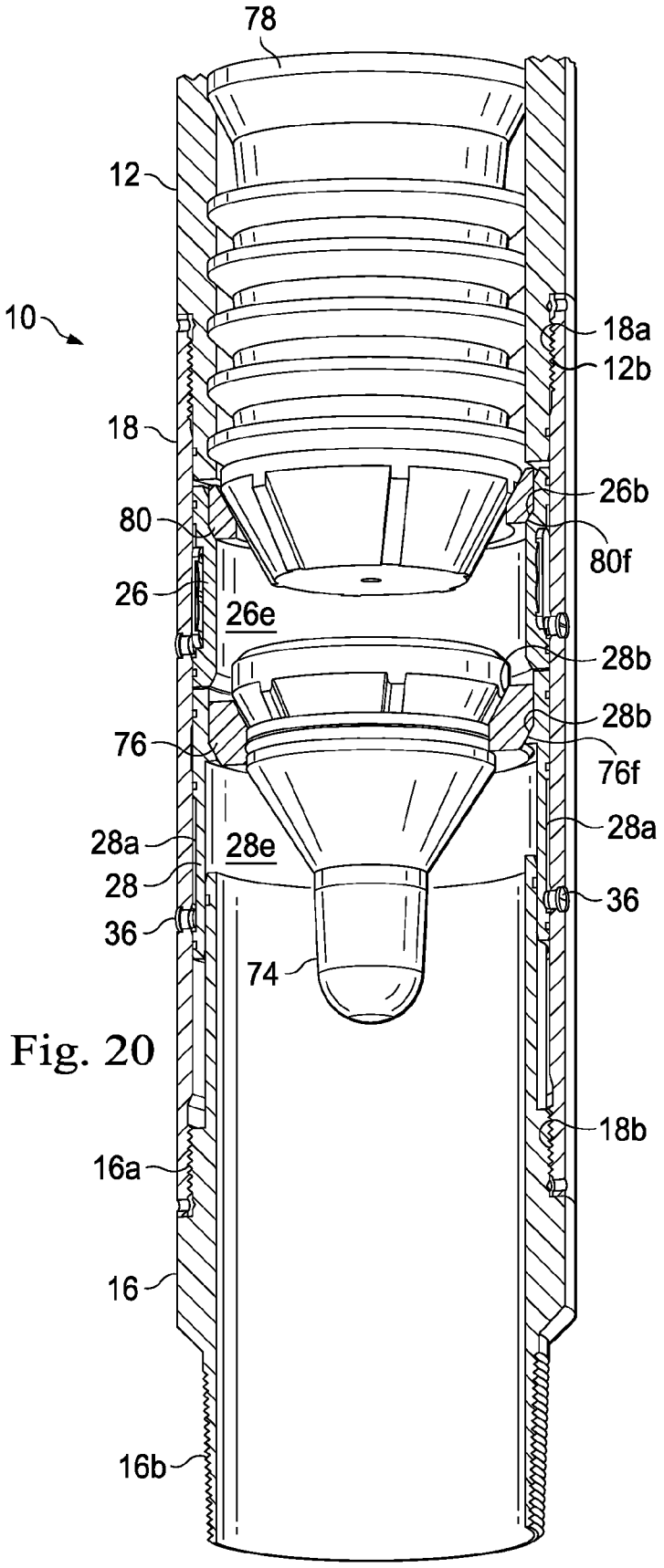
FIG. 20 is a perspective view of a section of a portion of a stage tool apparatus, according to an exemplary embodiment, the stage tool including a dart, a lower seat, a plug, and an upper seat.

In another embodiment, as illustrated in FIG. 20 with continuing reference to FIGS. 1-19*a*, the dart 66, the lower seat 32, the plug 70, and the upper seat 30 are omitted from the apparatus 10. Instead of the dart 66, the lower seat 32, the plug 70, and the upper seat 30, the exemplary embodiment of the apparatus 10 illustrated in FIG. 20 includes a dart 74, a lower seat 76, a plug 78, and an upper seat 80, respectively.

In an exemplary embodiment, as illustrated in FIGS. 21, 21A, 21B, 21C, and 21D with continuing reference to FIGS. 1-20, the dart 74 includes a top body member 74*a* coupled to a bottom body member 74*b*. The top body member 74*a* defines an outside surface 74*c*, and a plurality of circumferentially-spaced ribs 74*d* extending along the outside surface 74*c*. In an exemplary embodiment, the outside surface 74*c* is frusto-conical in shape. In an exemplary embodiment, the outside surface 74*c* and the ribs 74*d* extend downward at a 30 degree angle relative to longitudinal axis 74*da* of the dart 74. However, the outside surface 74*c* and the ribs 74*d* can extend downward at a variety of angles such as, for example, any angle between 20 degrees and 60 degrees.

Figure 21:
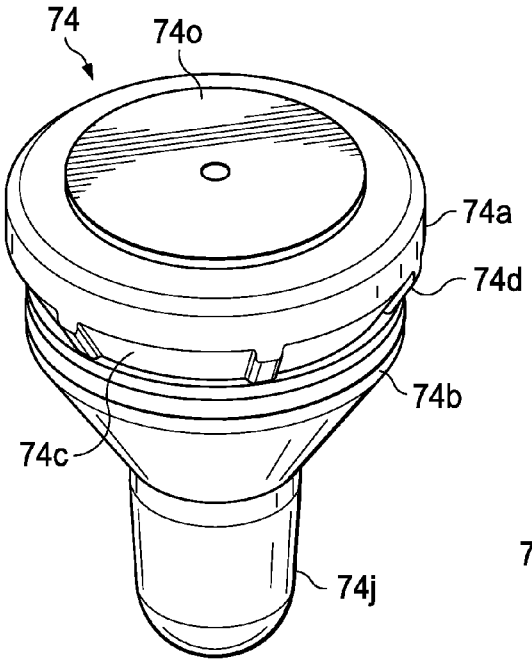
FIG. 21 is a perspective view of the dart of FIG. 20 according to an exemplary embodiment.
Figure 21B:
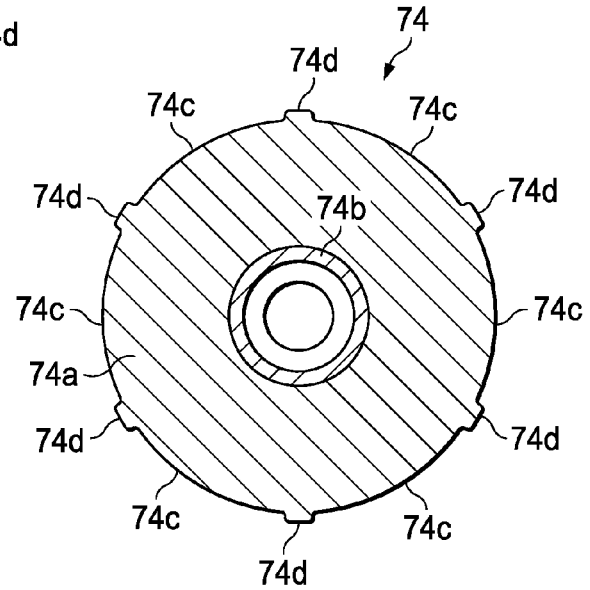
FIG. 21B is a sectional view of the dart of FIG. 20, taken along line 21B-21B of FIG. 21A, according to an exemplary embodiment.
Figure 21A:
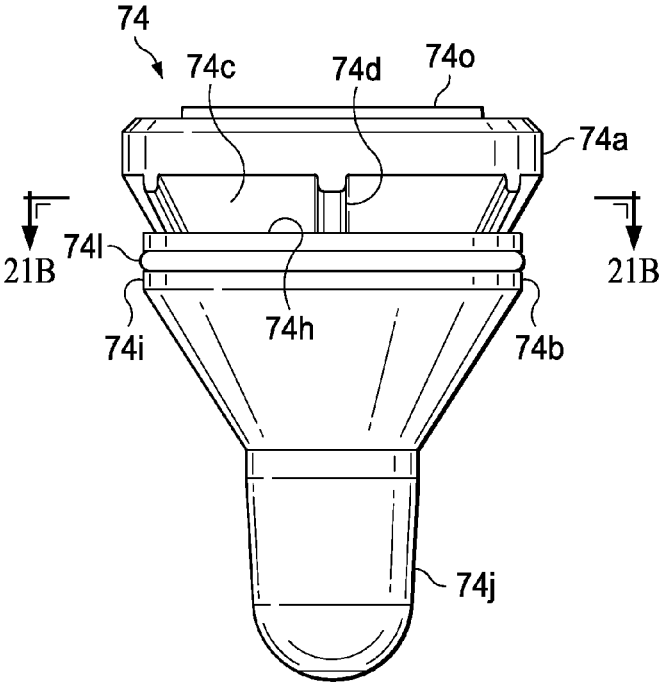
FIG. 21A is a side view of the dart of FIG. 20 according to an exemplary embodiment.
Figure 21C:
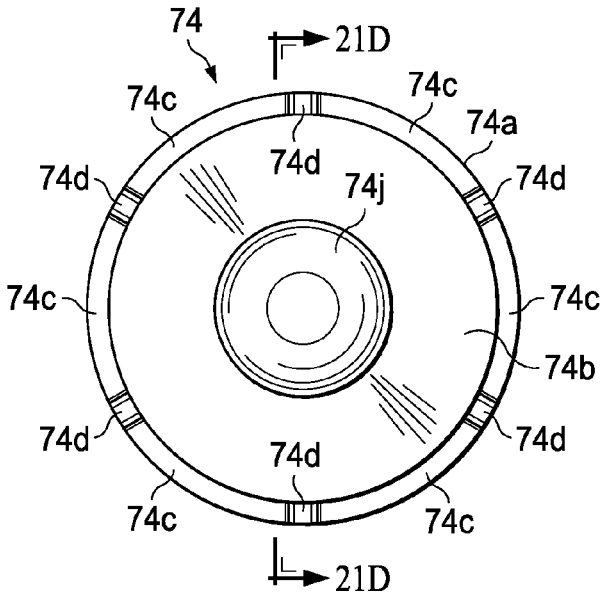
FIG. 21C is a bottom plan view of the dart of FIG. 20 according to an exemplary embodiment.
Figure 21D:
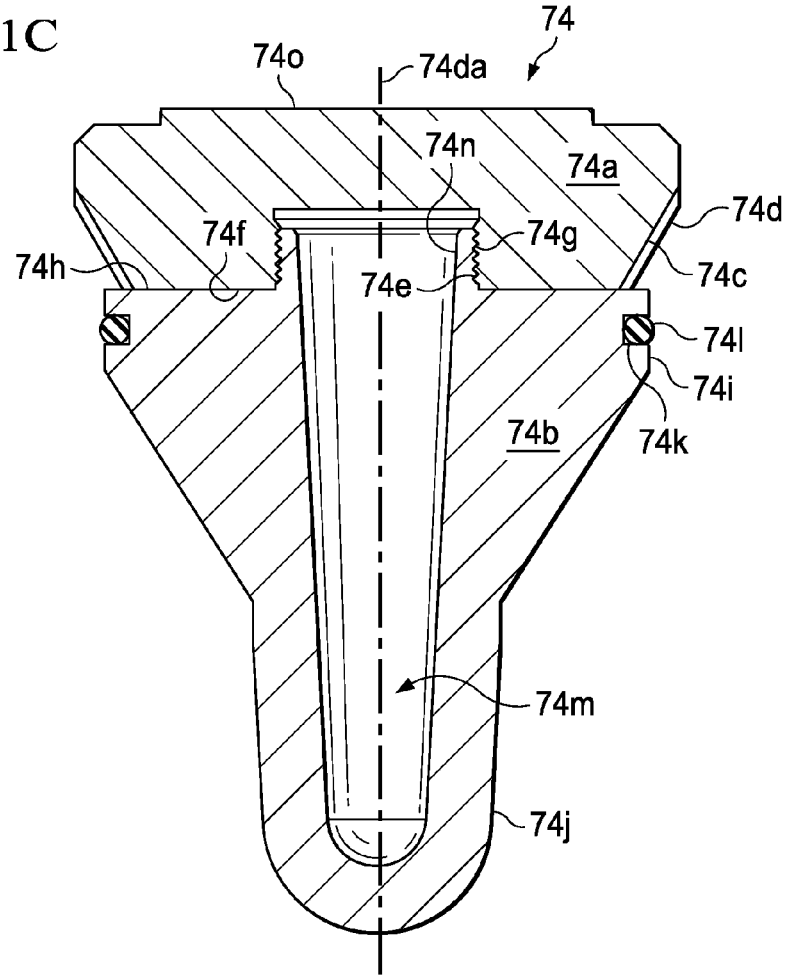
FIG. 21D is another sectional view of the dart of FIG. 20, taken along line 21D-21D of FIG. 21C but inverted, according to an exemplary embodiment.

As shown in FIG. 21D, the top body member 74*a* includes an internal threaded connection 74*e* that is formed through a bottom surface 74*f*. The lower body member 74*b* includes an external threaded connection 74*g* that extends from an upper surface 74*h* of the lower body member 74*b*. The internal threaded connection 74*e* is threadably engaged with the external threaded connection 74*g*, thereby coupling the top body member 74*a* to the lower body member 74*b*. The lower body member 74*b* defines an outside surface 74*i*. Proximate the upper surface 74*h*, the outside surface 74*i* is cylindrical in shape. As the lower body member 74*b* extends downward, the outside surface 74*i* tapers at a 30 degree angle, relative to the longitudinal axis 74*da* of the dart 74, towards a nose portion 74*j* of the lower body member 74*b*. However, the outside surface 74*i* may taper at a variety of angles such as, for example, any angle between 20 degrees and 60 degrees. An annular channel 74*k* is formed in the portion of the outside surface 74*i* that is cylindrical in shape (proximate the upper surface 74*h*). An annular sealing element, such as an o-ring 74*l*, is disposed in the annular channel 74*k*. A chamber 74*m*, having an opening 74*n*, is formed within the lower body member 74*b*. In an exemplary embodiment, the chamber 74*m* is formed in the distal axial end of the internal threaded connection 74*g*, and extends into the lower body member 74*b* and along the longitudinal axis 74*m*, terminating within the nose portion 74*j*. In an exemplary embodiment, lead shot or other weighted material is disposed within the chamber 74*m* to ballast the dart 74. In an exemplary embodiment, the coupling of the top body member 74*a* to the lower body member 74*b* prevents the lead shot that is disposed within the chamber 74*m* from exiting through the opening 74*n*. In an exemplary embodiment, the top body member 74*a* has a top surface 74*o*.

In an exemplary embodiment, the dart 74 is composed of at least one or more non-metallic materials. In an exemplary embodiment, the top body member 74*a* and/or the bottom body member 74*b* is composed of at least one or more non-metallic materials. In an exemplary embodiment, the dart 74 is composed of plastic. In an exemplary embodiment, the dart 74 is composed of phenolic. In an exemplary embodiment, the dart 74 is composed of Durez® 118. In an exemplary embodiment, the dart 74 is composed of Durez® 118 and is filled with lead shot.

Figure 22:
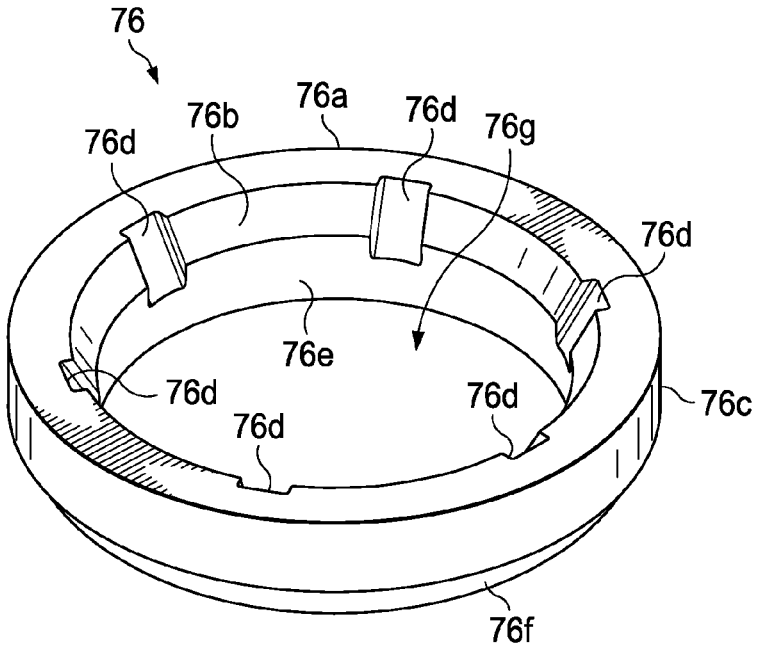
FIG. 22 is a perspective view of the lower seat of FIG. 20 according to an exemplary embodiment.
Figure 22A:
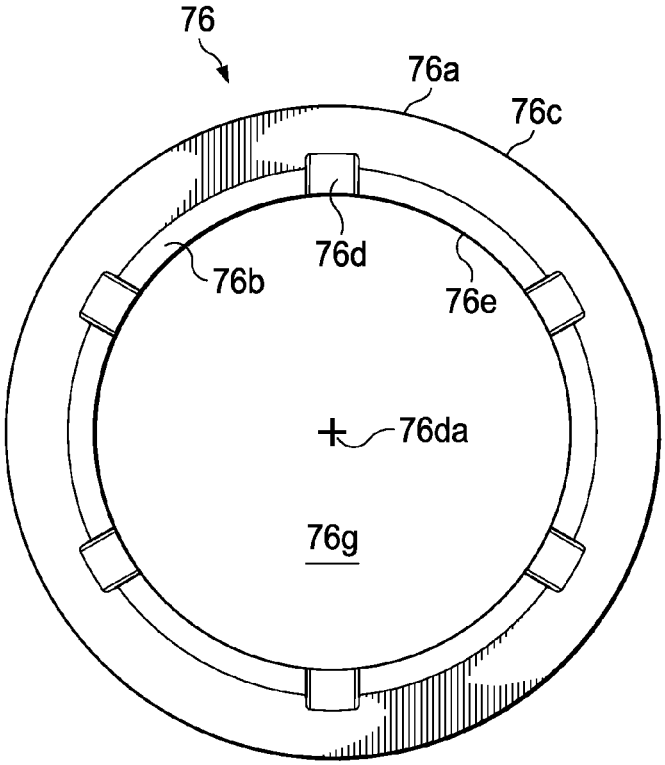
FIG. 22A is a top plan view of the lower seat of FIG. 20 according to an exemplary embodiment.

In an exemplary embodiment, as illustrated in FIGS. 22 and 22A with continuing reference to FIGS. 1-21D, the lower seat 76 includes an annular member 76*a* defining an inside surface 76*b* and an outside surface 76*c*. In an exemplary embodiment, the inside surface 76*b* is frusto-conical in shape. A plurality of circumferentially-spaced channels 76*d* are formed in the inside surface 76*b*. In an exemplary embodiment, each of the circumferentially-spaced channels 76*d* is sized to accommodate one of the circumferentially-spaced ribs 74*d* of the dart 74. In an exemplary embodiment, the inside surface 76*b* and the channels 76*d* taper at a 30 degree angle relative to longitudinal axis 76*da* of the lower seat 76. However, the inside surface 76*b* and the channels 76*d* may taper at a variety of angles such as, for example, any angle between 20 degrees and 60 degrees. The lower seat 76 further defines an inside surface 76*e* extending axially downward from the inside surface 76*b*. In an exemplary embodiment, the inside surface 76*e* is cylindrical in shape. In an exemplary embodiment, the outside surface 76*c* tapers inward to form an external shoulder 76*f*. The inwardly-tapered external shoulder 76*f* is spaced radially outwardly from the inside surface 76*e*. In an exemplary embodiment, the external shoulder 76*f* is configured to mate with the circumferentially-extending shoulder 28*b* to prevent downward movement of the lower seat 76 relative to the lower sleeve 28. The annular member 76*a* defines a seat passage 76*g*. Each of the inside surfaces 76*b* and 76*e* is adjacent the seat passage 76*g*.

In an exemplary embodiment, the lower seat 76 is composed of at least one or more non-metallic materials. In an exemplary embodiment, the lower seat 76 is composed of plastic. In an exemplary embodiment, the lower seat 76 is composed of phenolic. In an exemplary embodiment, the lower seat 76 is composed of Durez® 118. As shown in FIG. 20, the lower seat 76 is disposed in the lower sleeve 28, with the shoulder 76*f* mating against the shoulder 28*b*.

In an exemplary embodiment, as illustrated in FIGS. 23, 23A, 23B, 23C, and 23D with continuing reference to FIGS. 1-22A, the plug 78 includes a body member 78*a* defining an outside surface 78*b*, and a plurality of circumferentially-spaced ribs 78*c* extending along the outside surface 78*b*. In an exemplary embodiment, the outside surface 78*b* is frusto-conical in shape. In an exemplary embodiment, the outside surface 78*b* and the ribs 78*c* taper at a 30 degree angle relative to longitudinal axis 78*ca* of the plug 78. However, the outside surface 78*b* and the ribs 78*c* may taper at a variety of angles, such as for example, any angle between 20 degrees and 60 degrees.

Figure 23A:
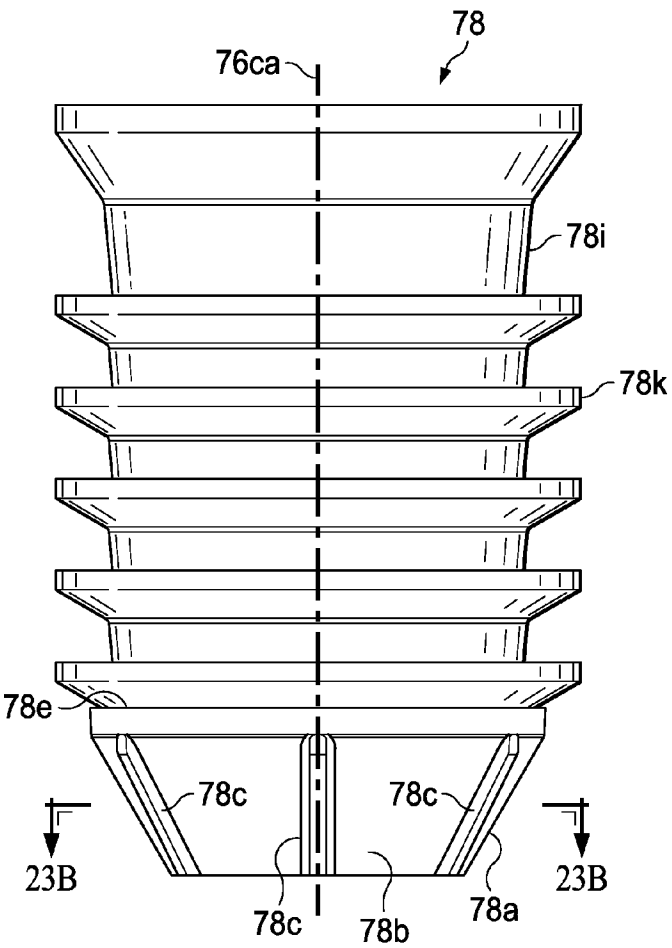
FIG. 23A is a side view of the plug of FIG. 20 according to an exemplary embodiment.
Figure 23:
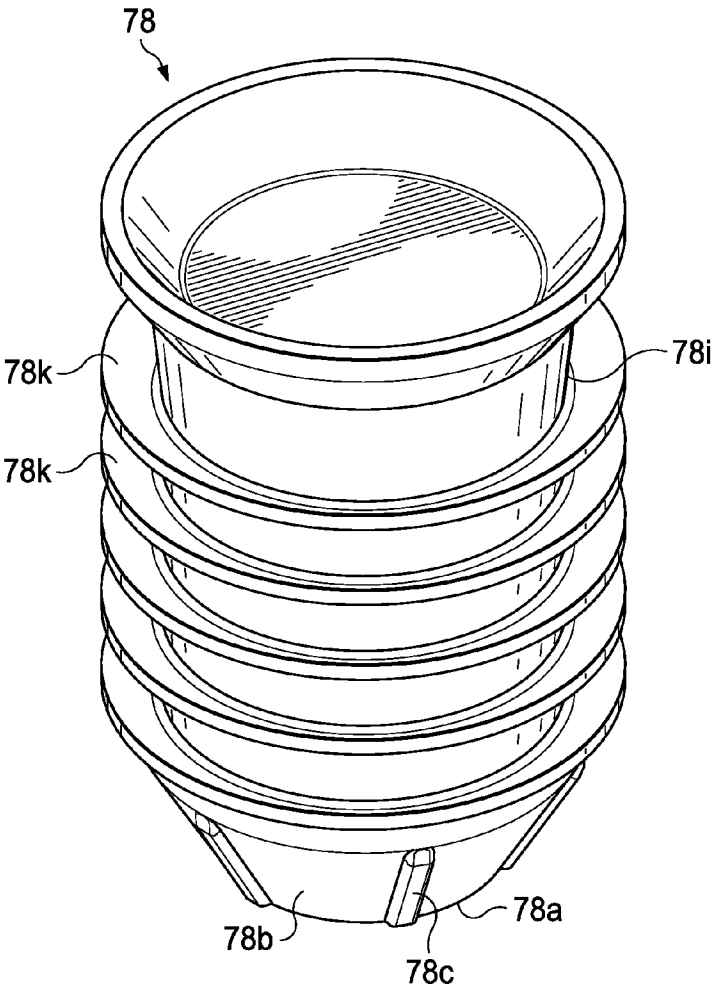
FIG. 23 is a perspective view of the plug of FIG. 20 according to an exemplary embodiment.
Figure 23B:
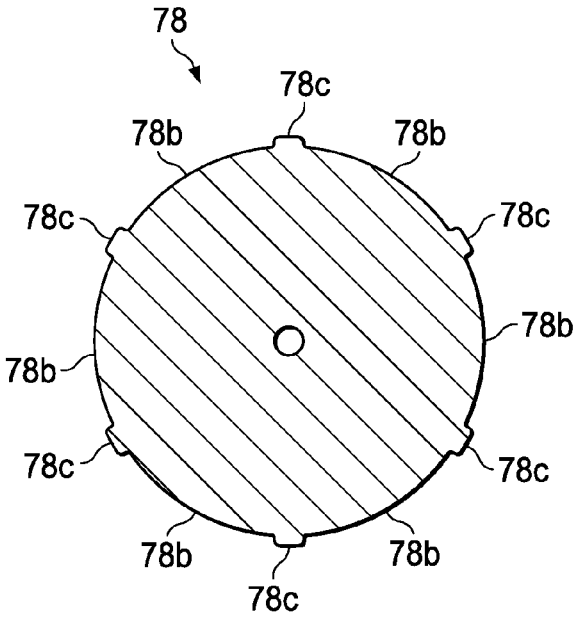
FIG. 23B is a sectional view of the plug of FIG. 20, taken along line 23B-23B of FIG. 23A, according to an exemplary embodiment.
Figure 23C:
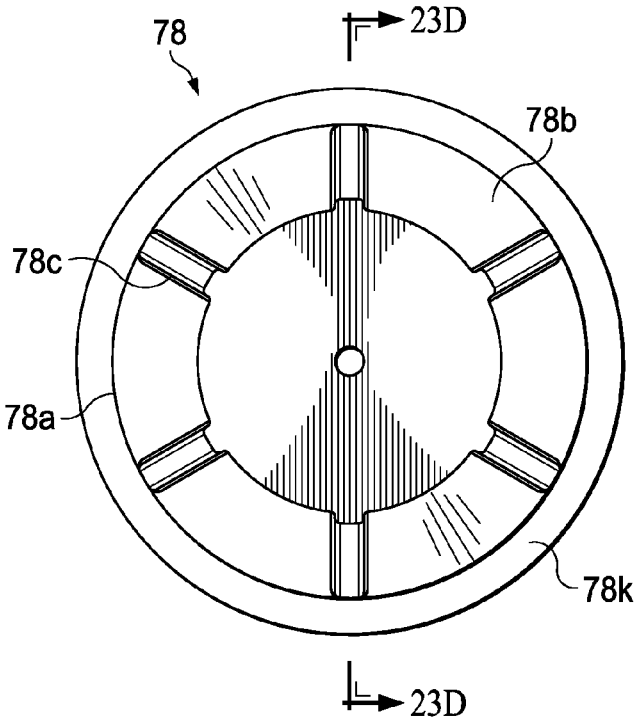
FIG. 23C is a bottom plan view of the plug of FIG. 20 according to an exemplary embodiment.
Figure 23D:
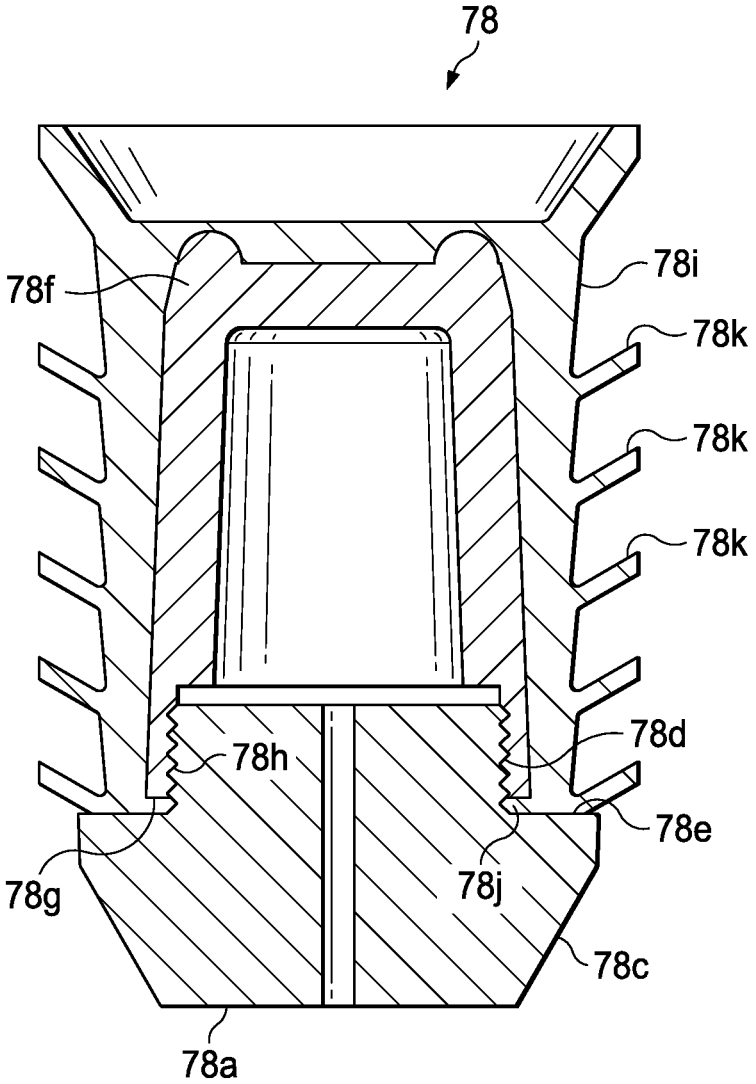
FIG. 23D is another sectional view of the plug of FIG. 20, taken along line 23D-23D of FIG. 23C but inverted, according to an exemplary embodiment.

As shown in FIG. 23D, an external threaded connection 78*d* extends from a top surface 78*e* of the body member 78*a*. A core element 78*f* defines a bottom surface 78*g*, and includes an internal threaded connection 78*h* formed in the bottom surface 78*g*. The internal threaded connection 78*h* is threadably engaged to with external threaded connection 78*d*, thereby coupling the core element 78*f* to the body element 78*a*. A wiper element 78*i* extends circumferentially around the core element 78*f*. In an exemplary embodiment, the wiper element 78*i* includes an inward flange 78*j* that extends between the top surface 78*e* of the body member 78*a* and the bottom surface 78*g* of the core element 78*f*. Thus, the coupling of the core element 78*f* to the body element 78*a* secures the wiper element 78*i* to each of the core element 78*f* and the body element 78. In several exemplary embodiments, one or more adhesives are used to further secure the wiper element 78*i*, the core element 78*f*, and the body element 78*a* together. The wiper element 78*i* includes a plurality of circumferentially-extending wipers or blades 78*k*, which are axially-spaced from one another along the longitudinal axis 78*ca*.

In an exemplary embodiment, the body member 78*a* is composed of at least one or more non-metallic materials. In an exemplary embodiment, the body member 78*a* is composed of plastic. In an exemplary embodiment, the body member 78*a* is composed of phenolic. In an exemplary embodiment, the body member 78*a* is composed of Durez® 118. In an exemplary embodiment, the core element 78*f* is composed of phenolic.

Figure 24:
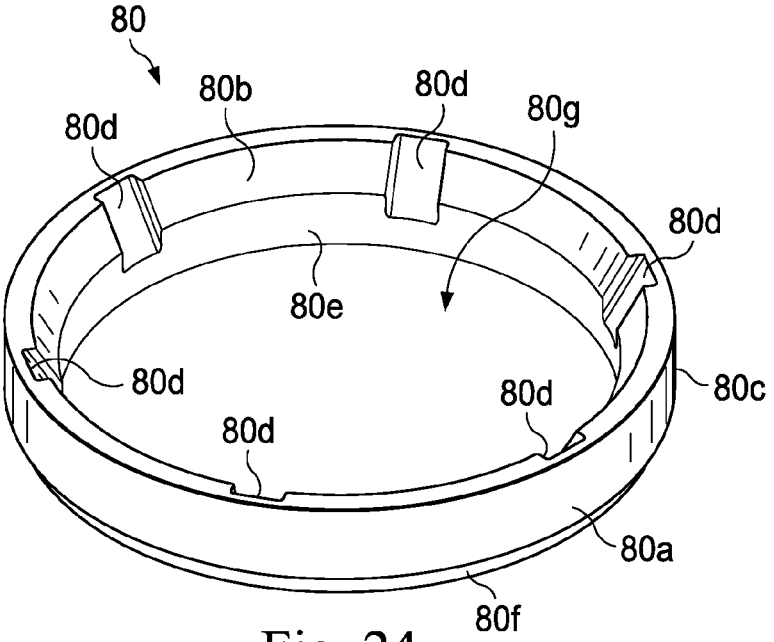
FIG. 24 is a perspective view of the upper seat of FIG. 20 according to an exemplary embodiment.
Figure 24A:
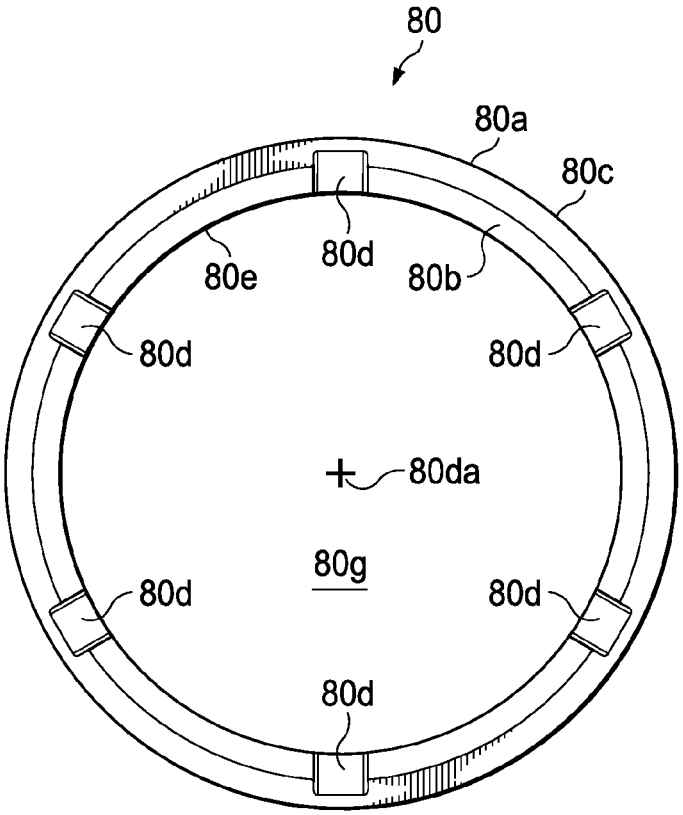
FIG. 24A is a top plan view of the upper seat of FIG. 20 according to an exemplary embodiment.

In an exemplary embodiment, as illustrated in FIGS. 24 and 24A with continuing reference to FIGS. 1-23D, the upper seat 80 includes an annular member 80*a* defining an inside surface 80*b* and an outside surface 80*c*. In an exemplary embodiment, the inside surface 80*b* is frusto-conical in shape. A plurality of circumferentially-spaced channels 80*d* are formed in the inside surface 80*b*. In an exemplary embodiment, each of the circumferentially-spaced channels 80*d* is sized to accommodate one of the circumferentially-spaced ribs 78*c*. In an exemplary embodiment, the inside surface 80*b* and the channels 80*d* taper at a 30 degree angle relative to longitudinal axis 80*da* of the upper seat 80. However, the inside surface 80*b* and the channels 80*d* may taper at a variety of angles such as, for example, any angle between 20 degrees and 60 degrees. The upper seat 80 further defines an inside surface 80*e*, which extends axially downward from the inside surface 80*b*. In an exemplary embodiment, the inside surface 80*e* is cylindrical in shape.

In an exemplary embodiment, the outside surface 80*c* tapers inward to form an external shoulder 80*f*. The inwardly-tapered external shoulder 80*f* is spaced radially outwardly from the inside surface 80*e*. In an exemplary embodiment, the external shoulder 80*f* is configured to mate with the circumferentially-extending shoulder 26*b* to prevent downward movement of the lower seat 76 relative to the upper sleeve 26. The annular member 80*a* defines a seat passage 80*g*. Each of the inside surfaces 80*b* and 80*e* is adjacent the seat passage 80*g*.

In an exemplary embodiment, the upper seat 80 is composed of at least one or more non-metallic materials. In an exemplary embodiment, the upper seat 80 is composed of plastic. In an exemplary embodiment, the upper seat 80 is composed of phenolic. In an exemplary embodiment, the upper seat 80 is composed of Durez® 118. As shown in FIG. 20, the upper seat 80 is disposed in the upper sleeve 26, with the shoulder 80*f* mating against the shoulder 26*b*.

Figure 25:
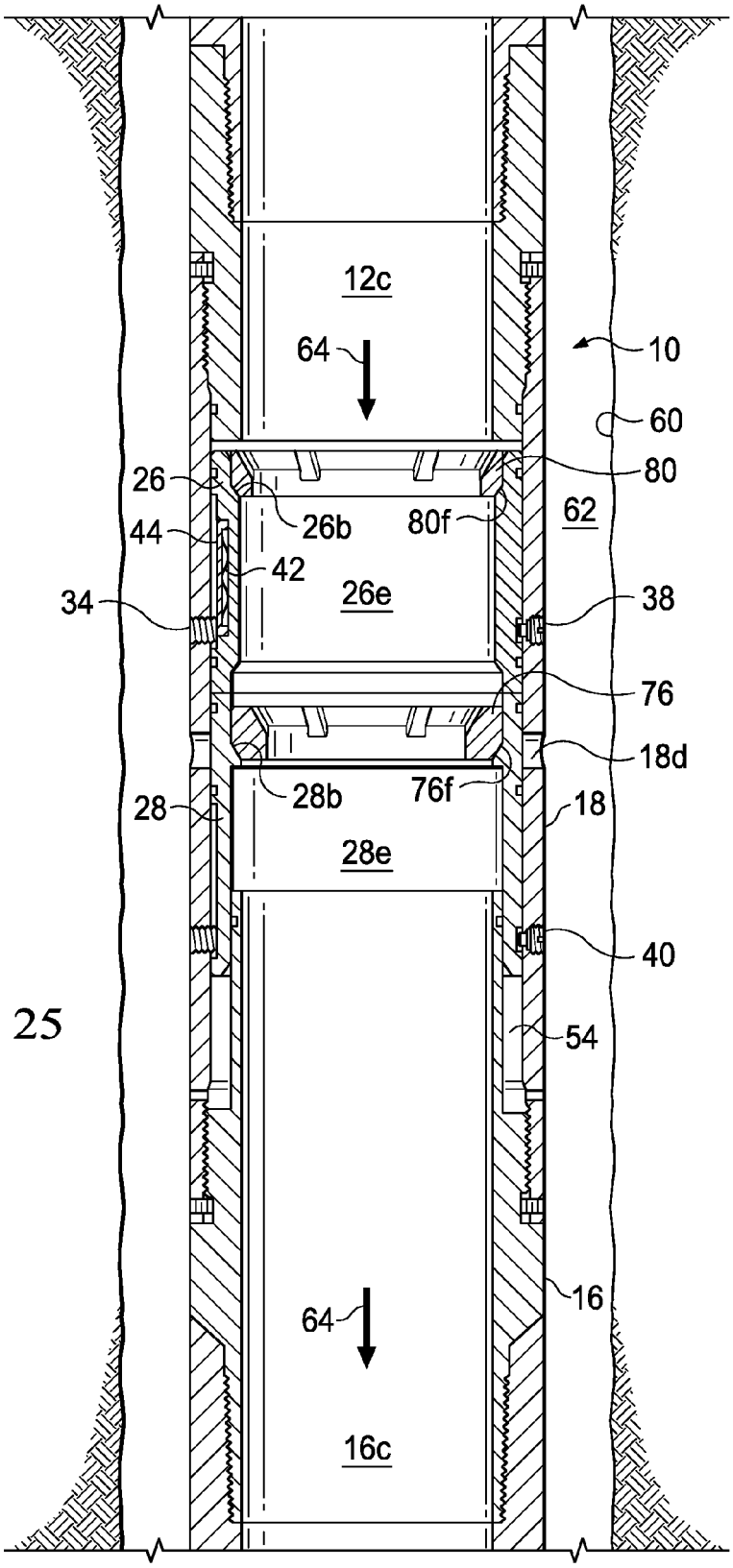
FIG. 25 is a partial sectional view of the stage tool apparatus of FIG. 20 extending within a wellbore and placed in an operational mode, according to an exemplary embodiment.

In operation, the embodiment of the apparatus 10 illustrated in FIG. 20 is identical to the above-described operation of the embodiments of the apparatus 10 illustrated in FIGS. 1-19*a*, subject to operational aspects of the embodiment of the apparatus 10 illustrated in FIG. 20, which operational aspects are described below. Similarly to the apparatus 10 illustrated in FIGS. 1-19*a*, the apparatus 10 illustrated in FIG. 20 is coupled to the box sub 12 and the pin sub 16 while in the assembled position. Additionally, the apparatus 10 illustrated in FIG. 20 is positioned within the wellbore 60 to define the annular region 62. As illustrated in FIG. 25, the apparatus 10 is in the neutral configuration, in which the lower seat 76 is disposed within the lower sleeve 28, so that the shoulder 76*f* engages the shoulder 28*b* of the lower sleeve 28 and the upper seat 80 is disposed within the upper sleeve 26, so that the shoulder 80*f* engages the shoulder 26*b* of the upper sleeve 26. Additionally, the neutral configuration generally corresponds to the assembled condition previously described above in which, inter alia, the lower sleeve 28 blocks the ports 18*d*, which are fluidically isolated from the internal passages 12*c*, 16*c*, 18*c*, 26*e* and 28*e*. As a result, the annular region 62 is fluidically isolated from the internal passages 12*c*, 16*c*, 18*c*, 26*e* and 28*e*.

In an exemplary embodiment, during or after the positioning of the apparatus 10 within the wellbore 60, the fluidic materials 64 are injected into and circulated through the apparatus 10 via the internal passage 12*c*, the internal passage 18*c*, the seat passage 80*g*, the internal passage 26*e*, the internal passage 28*e*, the seat passage 76*g*, and the internal passage 16*c*. In an exemplary embodiment, the fluidic materials 64 may be circulated through and out of the tubular string or casing of which the apparatus 10 is a part and into the wellbore 60.

Figure 26:
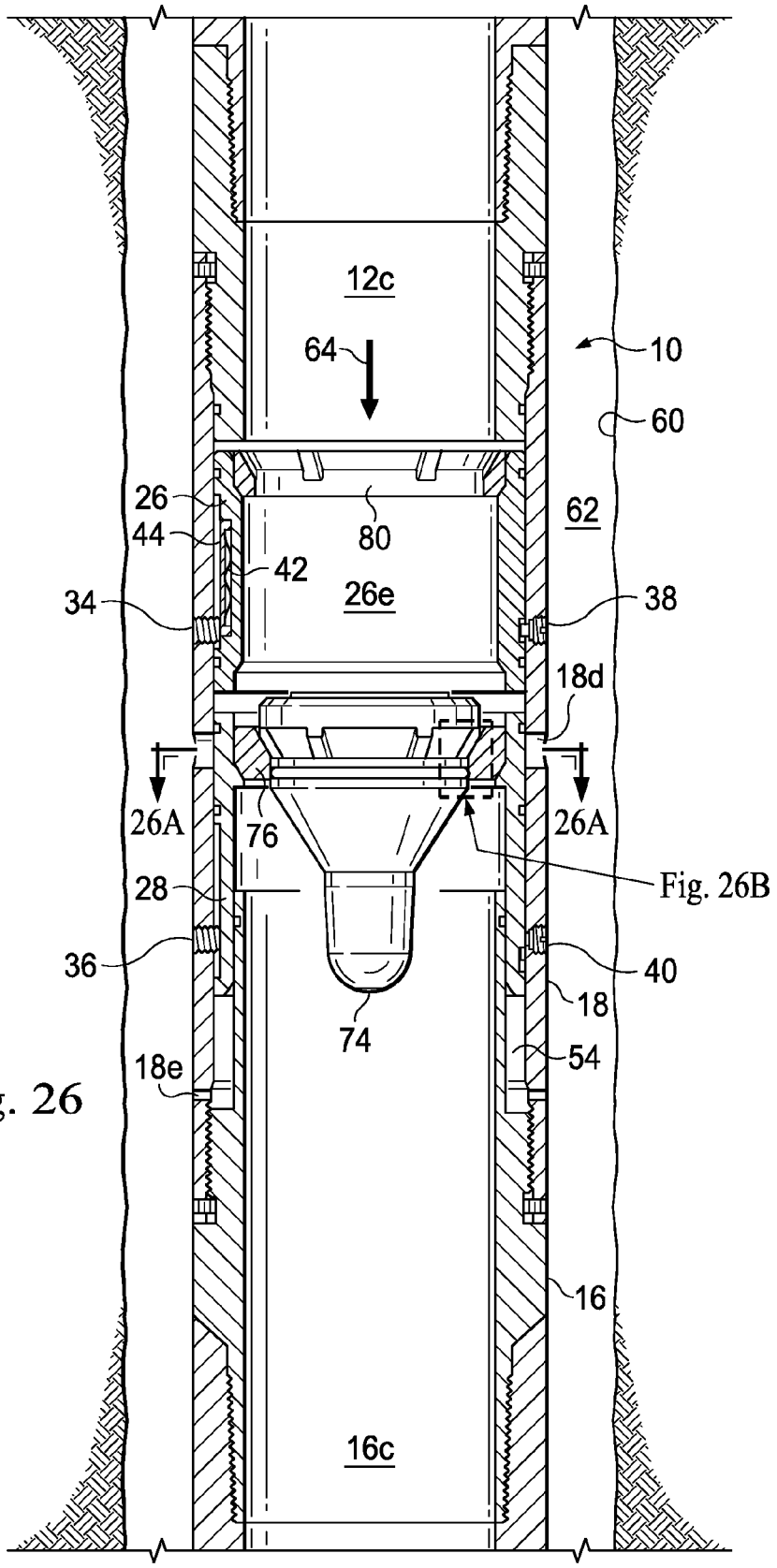
FIG. 26 is a partial sectional view of the stage tool apparatus of FIG. 20 extending within a wellbore and placed in an operational mode similar to that of FIG. 25, but also including the dart seated in the lower seat, according to an exemplary embodiment.

As illustrated in FIG. 26, a blocking element such as, for example, the dart 74, is injected into the apparatus 10 through at least the passage 12*c* and the internal passage 26*e* defined by the upper sleeve 26 until the dart 74 is seated in the lower seat 76. As a result, the flow of any fluidic materials, including the fluidic materials 64, through the seat passage 76*g* and therebelow is prevented or at least partially blocked.

Figure 26A:
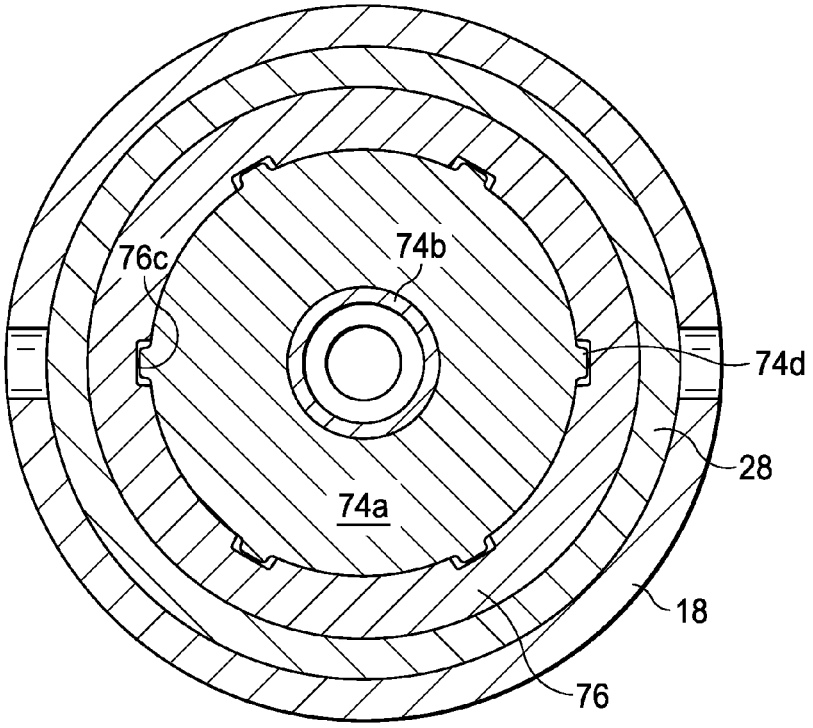
FIG. 26A is a sectional view, taken along line 26A-26A of FIG. 26, of the dart seated in the lower seat when the stage tool apparatus of FIG. 20 is in the operational mode of FIG. 26, according to an exemplary embodiment.
Figure 26B:
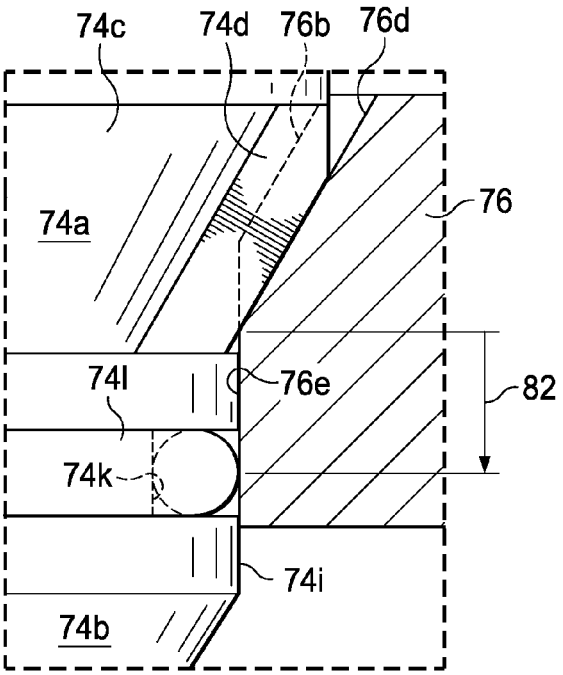
FIG. 26B is an enlarged view of a portion of FIG. 26.

In an exemplary embodiment, during operation, as shown in FIG. 26A, the ribs 74*d* extend within the channels 76*c*, respectively, to prevent or at least resist relative rotation between the dart 74 and the lower seat 76. As shown in FIG. 26B, the dart 74 has an axial position 82, relative to the inside surface 76*b* of the lower seat 76. When the dart 74 is in the axial position 82, the ribs 74*d* extend within the channels 76*c*, respectively, and the o-ring 74*l* sealingly engages the inside surface 76*e*. As a result, the flow of any fluidic materials through the seat passage 76*g* is prevented or at least partially blocked. Additionally, the internal passages 12*c* and 26*e* are fluidically isolated from the internal passages 28*c* and 16*c*.

Continued injection of the fluidic materials 64 into the apparatus 10, following the seating of the dart 74 in the lower seat 76, pressurizes the tubular string, of which the apparatus 10 is a part, above the dart 74. As a result, the fluidic materials 64 exerts a downward force on the top surface 74*o* of the top body 74*a*. As a result, the dart 74, the lower seat 76, and the lower sleeve 28 are urged downward, relative to at least the outer sleeve 18 and the shear screws 40 (and the wellbore 60), so that the radially-extending surface 28*f* of the lower sleeve 28 that is defined by the annular channel 28*d* bears against the shear portions 40*d* of the respective shear screws 40. Continued injection of the fluidic materials 64 into the apparatus 10, following the surface 28*f* initially bearing against the shear portions 40*d*, causes the respective shear portions 40*d* of the shear screws 40 to shear, at which point the dart 74, the lower seat 76, and the lower sleeve 28 move downward, as viewed in FIG. 27, relative to the upper sleeve 26 and the outer sleeve 18 of the apparatus 10 and relative to the wellbore 60.

During the downward movement of the dart 74, the lower seat 76, and the lower sleeve 28, the channels 28*a* of the lower sleeve 28 move relative to the fasteners 36. As a result of the extension of the fasteners 36 into the respective channels 28*a*, the fasteners 36 guide the lower sleeve 28 as it moves downward, continuing to prevent or at least resist any relative rotation between the lower sleeve 28 and the outer sleeve 18. During the downward movement of the dart 74, the lower seat 76, and the lower sleeve 28, the lower end of the lower sleeve 28 is further received by the annular region 54.

Figure 27:
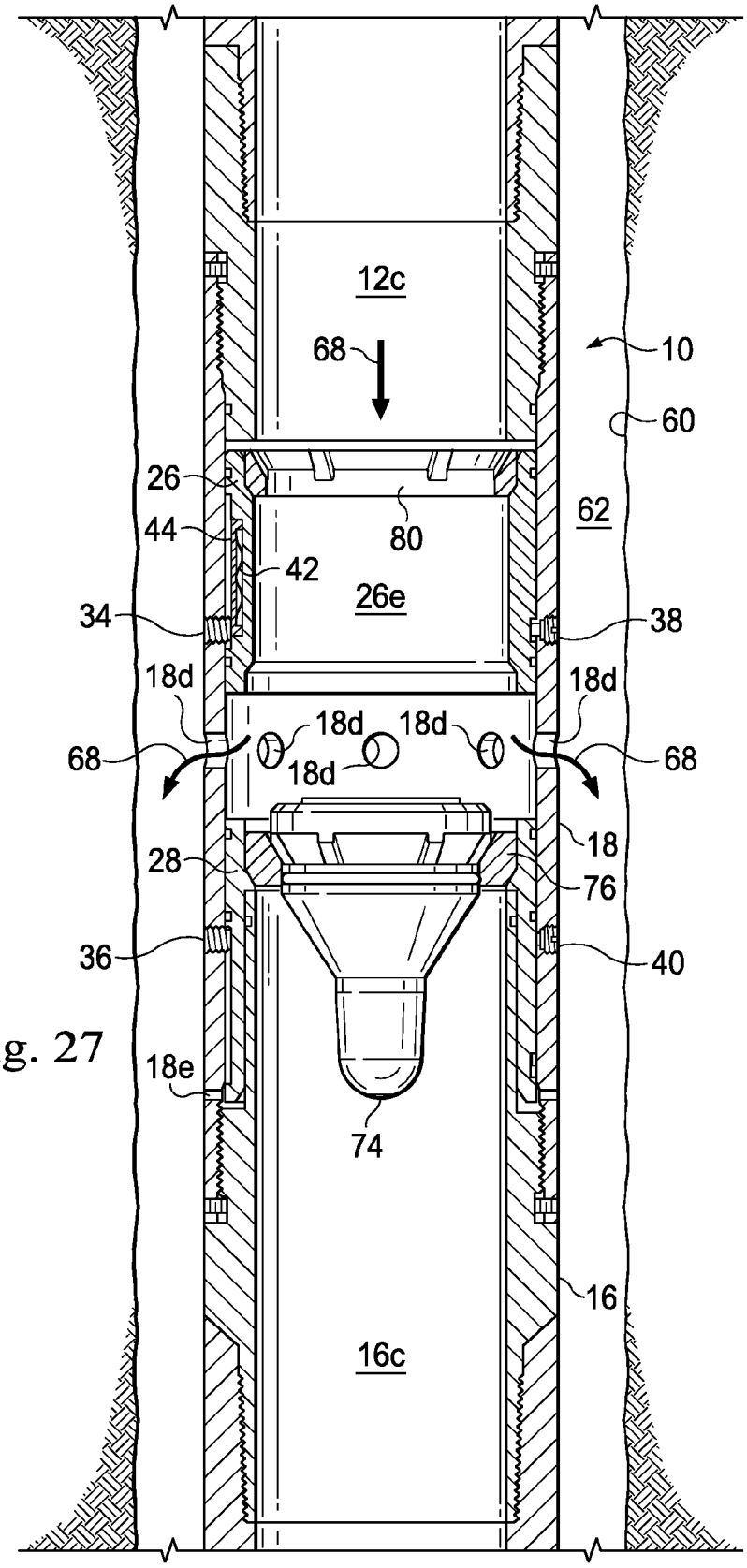
FIG. 27 is a partial sectional view of the stage tool apparatus of FIG. 20 extending within a wellbore and placed in an operational mode, according to an exemplary embodiment.

As illustrated in FIG. 27, the dart 74, the lower seat 76, and the lower sleeve 28 continue to move downward until the fasteners 36 engage the surfaces of the lower sleeve 28 defined by the upper ends of the respective channels 28*a*. As a result of these engagements, the lower sleeve 28 and thus the dart 74 and the lower seat 76 are prevented from moving any further downward. As a result of the downward movement of the dart 74, the lower seat 76, and the lower sleeve 28, the apparatus 10 is in an open configuration in which the ports 18*d* are not blocked by any of the upper sleeve 26 and the lower sleeve 28 and thus the annular region 62 is in fluid communication with at least the internal passage 12*c*, the internal passage 26*e*, and the internal passage 18*c* via the ports 18*d*. In an exemplary embodiment and while in the open configuration, the o-ring 74*l* continues to sealingly engage the inside surface 76*e* to fluidically isolate the internal passages 12*c* and 26*e* from internal passages 28*c* and 16*c*. In an exemplary embodiment and while in the open configuration, the dart 74 continues to prevent or at least partially block the flow of any fluidic materials through the seat passage 76*g* and into the internal passage 26*e*.

With continuing reference to FIG. 27, during or after the downward movement of the lower seat 76 and the lower sleeve 28, a fluidic material, such as the hardenable fluidic material 68, is injected into the apparatus 10 via the tubular string of which the apparatus 10 is a part, and into the internal passage 12*c*. The hardenable fluidic material 68 flows out of the apparatus 10 through the ports 18*d* of the outer sleeve 18 and into the annular region 62. As a result, an annular body of the hardenable fluidic material 68 is formed within the annular region 62. In an exemplary embodiment and while the hardenable fluidic material 68 flows out of the apparatus 10 through the ports 18*d*, the o-ring 74*l* continues to sealingly engage the inside surface 76*e* to fluidically isolate the internal passages 12*c* and 26*e* from internal passages 28*c* and 16*c*. In an exemplary embodiment and while the hardenable fluidic material 68 flows out of the apparatus 10 through the ports 18*d*, the dart 74 continues to block the flow of any fluidic materials through the seat passage 76*g* and into the internal passage 26*e*.

Figure 28:
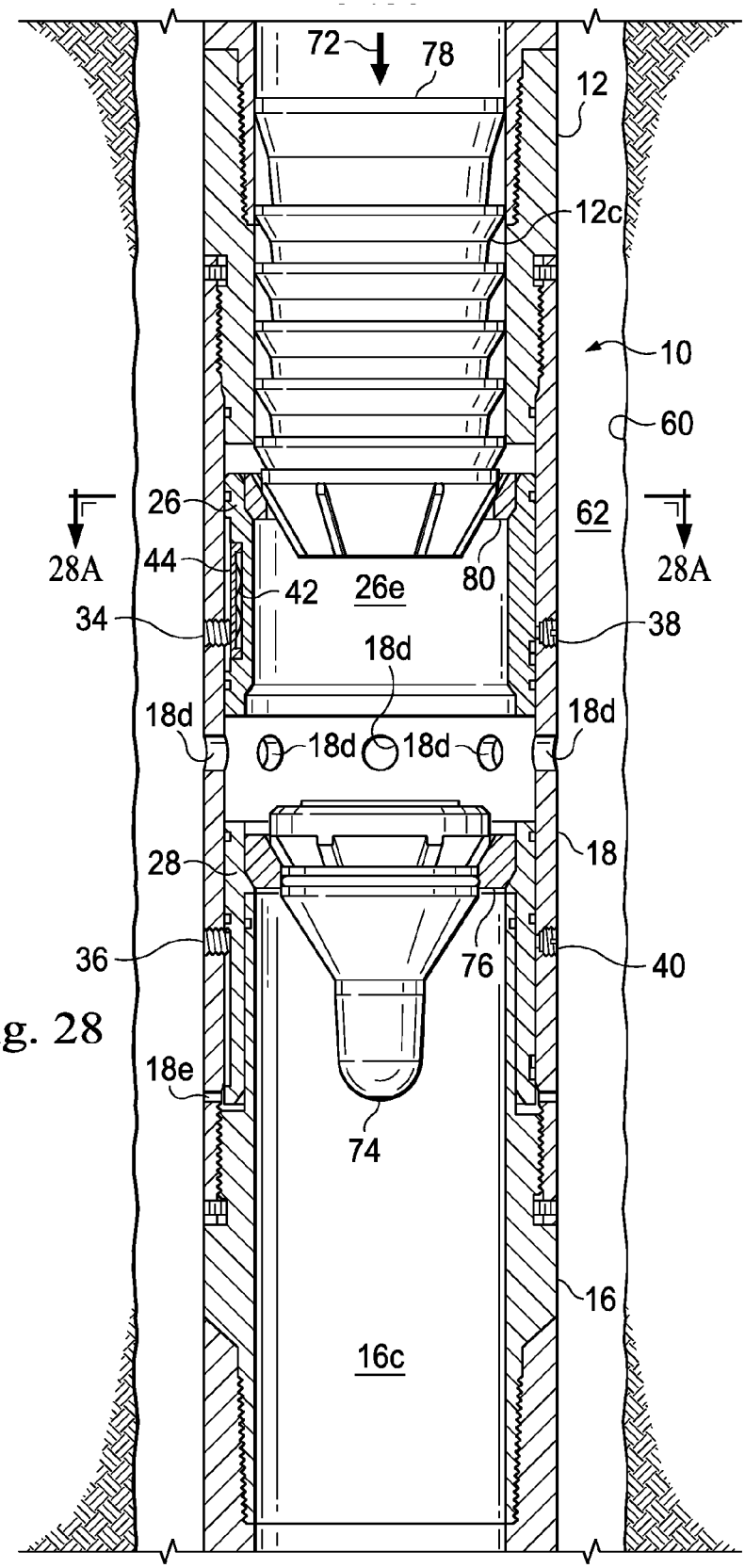
FIG. 28 is a partial sectional view of the stage tool apparatus of FIG. 20 extending within a wellbore and placed in an operational mode similar to that of FIG. 27, but also including the plug seated within the upper seat, according to an exemplary embodiment.
Figure 28A:
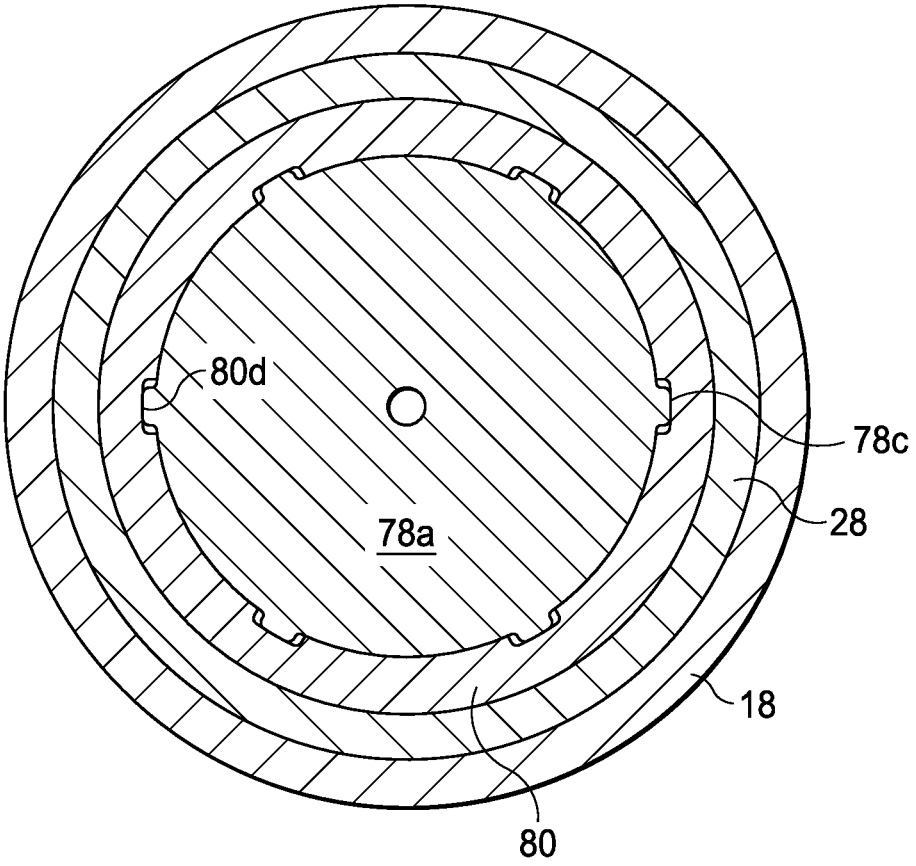
FIG. 28A is a partial sectional view of the plug seated in the upper seat when the stage tool apparatus of FIG. 20 is in the operational mode of FIG. 28, according to an exemplary embodiment.

As illustrated in FIG. 28, before, during, or after the curing of the annular body of the hardenable fluidic material 68, a blocking element such as, for example, the plug 78, is injected into the apparatus 10 through at least the passage 12*c*, until the plug 78 is seated in the upper seat 80. As a result, the flow of any fluidic materials through the seat passage 80*g*, the upper sleeve 26, and the remainder of the apparatus 10 therebelow is blocked. Fluidic materials 72 are injected into the apparatus 10, following the seating of the plug 78 in the upper seat 80, thereby pressurizing the tubular string of which the apparatus 10 is a part. Continued injection of the fluidic materials 72 causes the respective shear portions 38*d* of the shear screws 38 to shear, at which point the plug 78, the upper seat 80, and the upper sleeve 26 move downward, as viewed in FIG. 18, relative to the outer sleeve 18 and the lower sleeve 28 of the apparatus 10 and relative to the wellbore 60. Each of the shear portions 38*d* shears along the respective shear plane 38*g*. During the downward movement of the plug 78, the upper seat 80, and the upper sleeve 26, the channels 26*a* of the upper sleeve 26, the springs 42, and the lock keys 44 move relative to the fasteners 34. As a result of the extension of the fasteners 34 into the respective channels 26*a*, the fasteners 34 guide the upper sleeve 28 as it moves downward, continuing to prevent or at least resist any relative rotation between the upper sleeve 26 and the outer sleeve 18. In an exemplary embodiment, during operation, as shown in FIG. 28A, the ribs 78*c* extend within the channels 80*d*, respectively, to prevent or at least resist relative rotation between the plug 78 and the upper seat 80.

Figure 29:
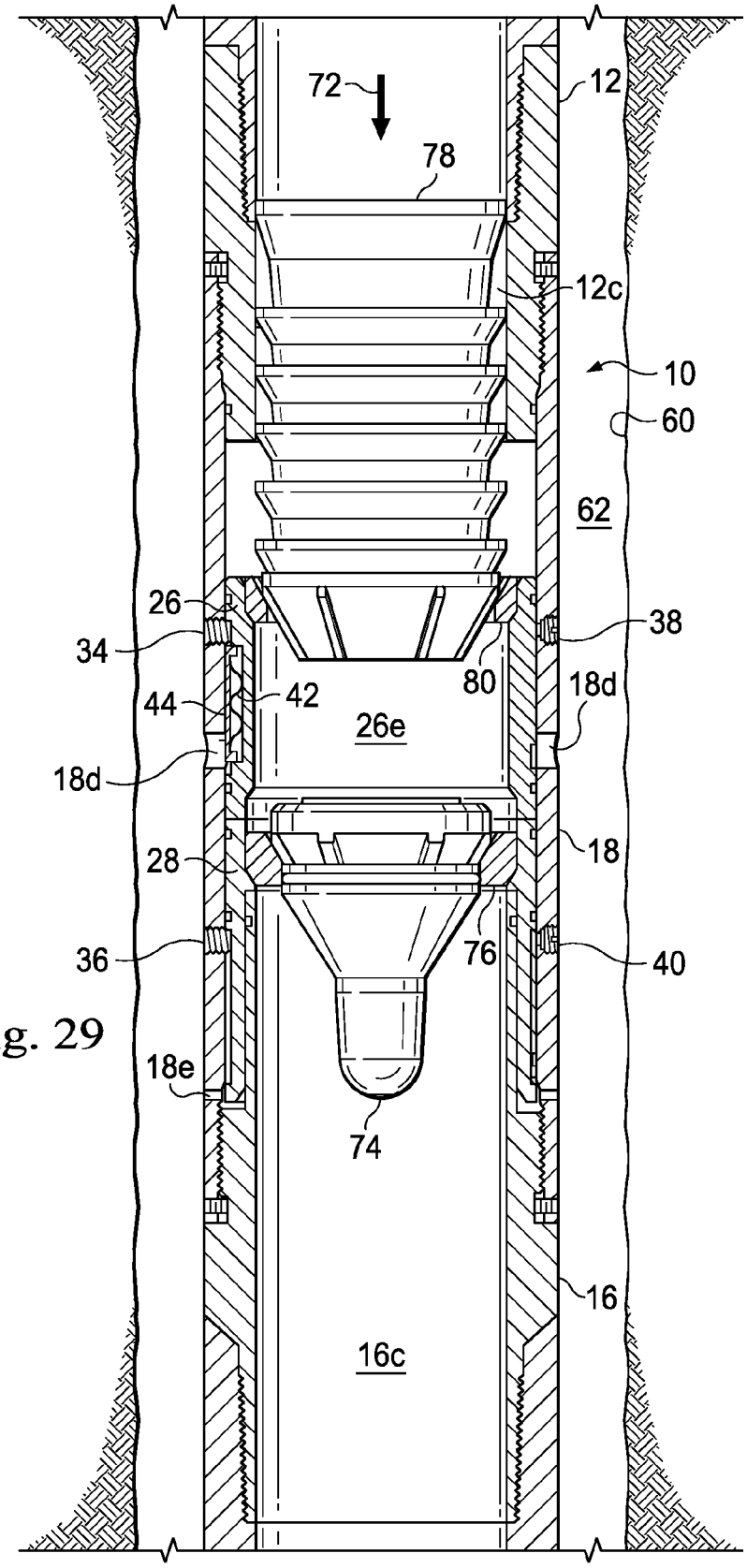
FIG. 29 is a partial sectional view of the stage tool apparatus of FIG. 20 extending within a wellbore and placed in an operational mode, according to an exemplary embodiment.

As illustrated in FIG. 29, the plug 78, the upper seat 80, and the upper sleeve 26 continue to move downward until the fasteners 34 engage the surfaces of the upper sleeve 26 defined by the upper ends of the respective channels 26*a* (shown in FIG. 19*a*). As a result of these engagements, the upper sleeve 26 and thus the plug 78 and the upper seat 80 are prevented from moving any further downward. As a result of this downward movement of the plug 78, the upper seat 80, and the upper sleeve 26, the apparatus 10 is in the closed configuration in which the ports 18*d* are blocked by the upper sleeve 26 and thus the annular region 62 is fluidically isolated from at least the internal passage 26*e* defined by the upper sleeve 26. As another result of this downward movement of the plug 78, the upper seat 80, and the upper sleeve 26, each of the fasteners 34 is no longer engaging the side 44*aa* of the bar member 44*a* of the respective lock key 44 (shown in FIG. 19*a*). As a result, the springs 42 sufficiently relax to push the respective lock keys 44 radially outward within the respective channels 26*a*.

As a result of the radially outward movement of the lock keys 44, the lock keys 44 are radially positioned so that each fastener 34 is axially disposed between a surface of the upper sleeve 26 defined by the upper end of the respective channel 26*a* and at least the end portion 44*ad* of the respective lock key 44, as shown in FIG. 19*a*. Moreover, each fastener 34 continues to be circumferentially disposed between the vertically-extending side walls of the upper sleeve 26 that are defined by the respective channel 26*a*. As a result, the upper sleeve 26 is jammed; the upper sleeve 26 cannot appreciably translate or rotate relative to the lower sleeve 28 or the outer sleeve 18.

The jammed upper sleeve 26 prevents any appreciable upward movement of the lower sleeve 28, as viewed in FIG. 29, and the respective engagements between the fasteners 36 and the surfaces of the lower sleeve 28 defined by the upper ends of the respective channels 28*a* prevent any downward movement of the lower sleeve 28, as viewed in FIG. 29. Moreover, each fastener 36 continues to be circumferentially disposed between the vertically-extending side walls of the lower sleeve 28 that are defined by the respective channel 28*a*. As a result, the lower sleeve 28 is jammed; the lower sleeve 28 is not permitted to appreciably translate or rotate relative to the upper sleeve 26 or the outer sleeve 18. Since neither the upper sleeve 26 nor the lower sleeve 28 is permitted to appreciably rotate or translate relative to each other or the outer sleeve 18, the apparatus 10 is thus locked in the closed configuration illustrated in FIG. 29. This locking of the upper sleeve 26 and the lower sleeve 28 facilitates any drill-out operation of the upper seat 80 and the lower seat 76.

As yet another result of the above-described downward movement of the upper sleeve 26, the upper sleeve 26 is engaged with the lower sleeve 28 so that lower end portions of the upper sleeve 26 defined by the arcuate notches 26*c* and 26*d* are again interposed between upper end portions of the lower sleeve 28 defined in part by the arcuate notch 28*c*; and axial gaps are defined between axially-facing end surfaces defined by the interposed lower end portions of the upper sleeve 26 and corresponding axially-facing end surfaces defined by the interposed upper end portions of the lower sleeve 28; in an exemplary embodiment, grease is disposed in the axial gaps to eliminate any metal-to-metal surface seal.

As a result of the ribs 78*c* extending within the channels 80*d*, as shown in FIG. 28A, relative rotation between the plug 78 and the upper seat 80 is prevented or at least resisted. In an exemplary embodiment, the resulting prevention or resistance of relative rotation between the plug 78 and the upper seat 80 facilitates any drill-out operation during which the plug 78, the upper seat 80, the dart 74, and the lower seat 76 are drilled out. Similarly, as a result of the ribs 74*d* extending within the channels 76*c*, as shown in FIG. 26A, the resulting prevention or resistance of relative rotation between the dart 74 and the lower seat 76 facilitates any drill-out operation during which the plug 78, the upper seat 80, the dart 74 and the lower seat 76 are drilled out.

In several exemplary embodiments, the non-metallic material(s) of which the lower seat 76 are composed facilitate the drill out of the lower seat 76. The non-metallic material(s), of which the dart 74 or at least the body member 74*a* thereof are composed, facilitate the drill out of the dart 74. The non-metallic material(s), of which at least the body member 78*a* of the plug 78 are composed, facilitate the drill out of the plug 78. The non-metallic material(s), of which the upper seat 80 are composed, facilitate the drill out of the upper seat 80. When compared with metallic materials, the non-metallic material(s) may be less resistant to drill-out operations, increasing the speed at which the apparatus 10 may be drilled out.

Figure 30:
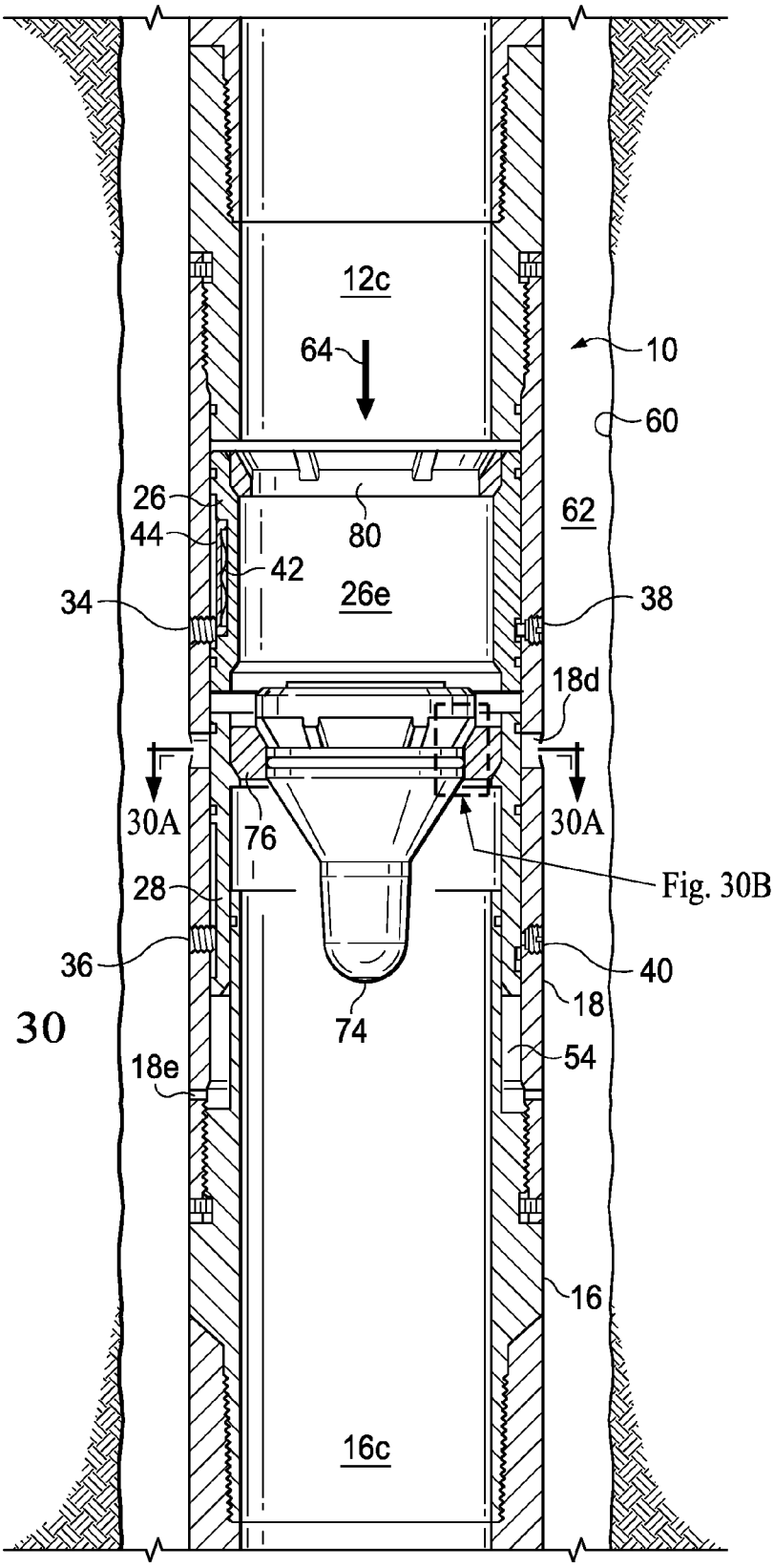
FIG. 30 is a view similar to that of FIG. 26 but depicting the apparatus of FIG. 20 placed in another operational mode, according to an exemplary embodiment.
Figure 30A:
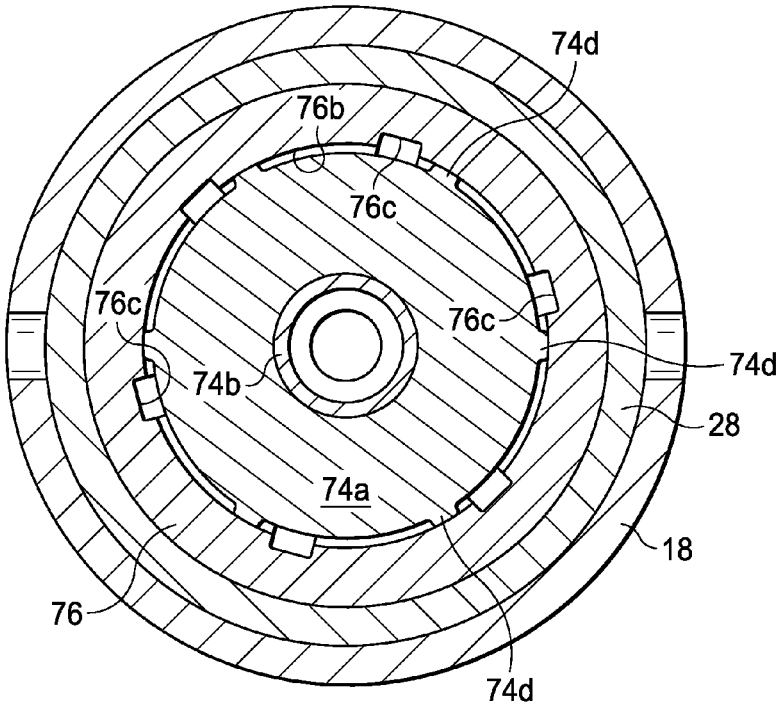
FIG. 30A is a partial sectional view of the dart seated in the lower seat when the stage tool apparatus of FIG. 20 is in the operational mode of FIG. 30, according to an exemplary embodiment.
Figure 30B:
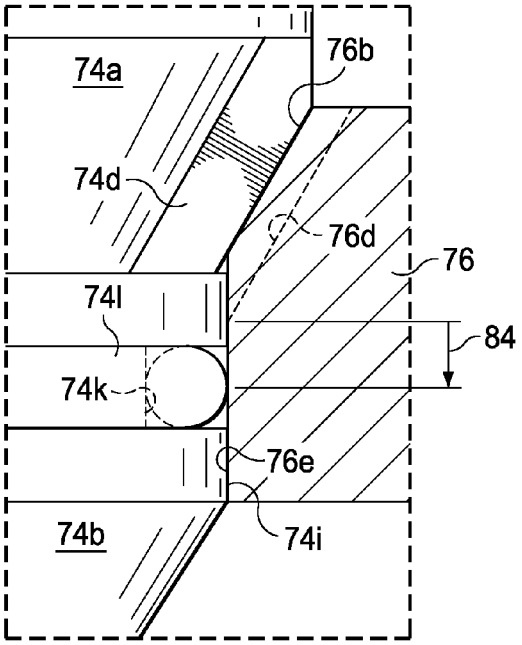
FIG. 30B is another partial sectional view of the dart seated in the lower seat when the stage tool apparatus of FIG. 20 is in the operational mode of FIG. 30, according to an exemplary embodiment.

In another exemplary embodiment and as illustrated in FIGS. 30, 30A, and 30B, the ribs 74*d* of the dart 74 do not initially extend within the channels 76*c* of the lower seat 76, respectively, when the apparatus 10 is in the closed configuration. Instead, the ribs 74*d* engage the inside surface 76*b*. As a result, and as shown in FIG. 30B, the dart 74 has an axial position 84, relative to the inside surface 76*b* of the lower seat 76. When the dart 74 is in the axial position 84, the ribs 74*d* do not extend within the channels 76*c*, respectively, but the o-ring 74*l* still sealingly engages the inside surface 76*e*. Thus, the o-ring 74*l* sealingly engages the inside surface 76*e* when the dart 74 is in either the axial position 82 or the axial position 84. At the axial position 84, the o-ring 74*l* is closer to the lower ends of the channels 76*c*, than when the dart 74 is in the axial position 82, because the ribs 74*d* are contacting the inside surface 76*b*, rather than extending within the channels 76*c*. However, even if the ribs 74*d* do not initially extend within the channels 76*c*, respectively, in several exemplary embodiments, during a drill-out operation the dart 74 may undergo rotation, relative to the lower seat 76, which rotation may cause the ribs 74*d* to extend within the channels 76*c*, respectively. Such extensions may facilitate the remainder of the drill-out operation, increasing the speed at which the apparatus 10 may be drilled out.

Figure 31:
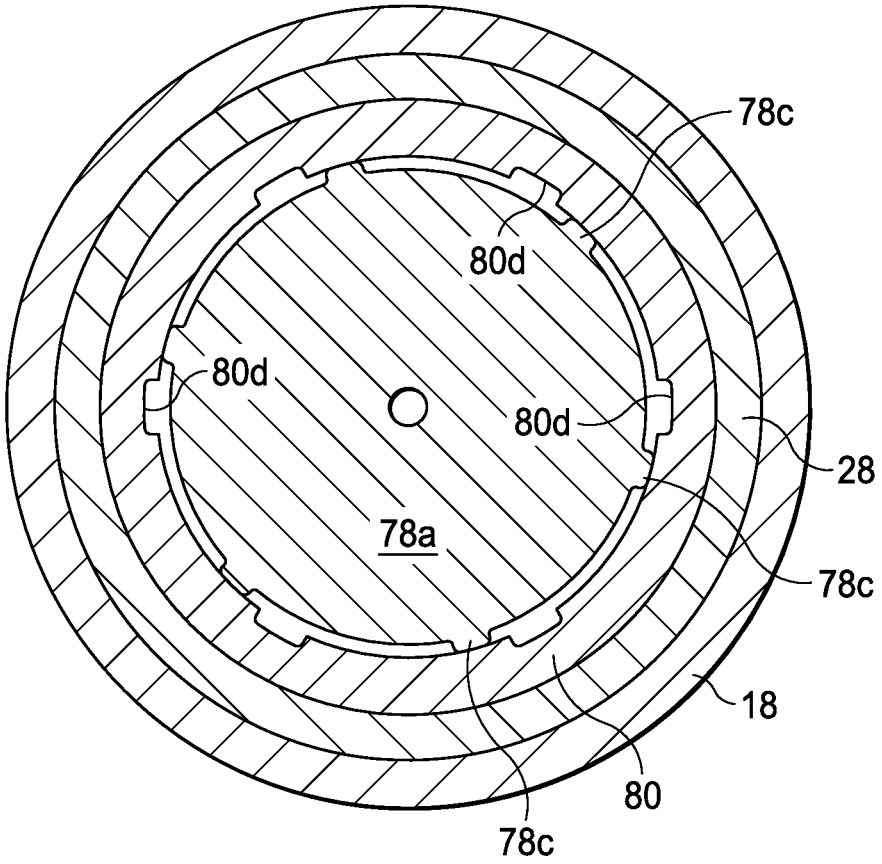
FIG. 31 is a view similar to that of FIG. 28A but depicting the apparatus of FIG. 20 placed in another operational mode, according to an exemplary embodiment.

In another exemplary embodiment and as illustrated in FIG. 31, the ribs 78*c* of the plug 78 do not initially extend within the channels 80*d* of the upper seat 80, respectively. Instead, the ribs 78*c* contact or are otherwise engaged with the inside surface 80*b*. However, even if the ribs 78*c* do not initially extend within the channels 80*d*, respectively, during a drill-out operation the plug 78 may undergo rotation, relative to the upper seat 80, which rotation may cause the ribs 78*c* to extend within the channels 80*d*, respectively. Such extensions may facilitate the remainder of the drill-out operation, increasing the speed at which the apparatus 10 may be drilled out.

In an exemplary embodiment, any two or more of the outside surfaces 74*c* and 78*b* and the inside surfaces 76*b* and 80*b* taper at equal angles to encourage the engagement of the outside surface 74*c* to the inside surface 76*b* and the engagement of the outside surface 78*b* to the inside surface 80*b*. However in another exemplary embodiment, two or more of the outside surfaces 74*c* and 78*b* and the inside surfaces 76*b* and 80*b* taper at different angles and the outside surface 74*c* still engages the inside surface 76*b* and the outside surface 78*b* still engages the inside surface 80*b*. In an exemplary embodiment, any two or more of the ribs 74*d* and 78*c* and the channels 76*d* and 80*d* taper at equal angles to encourage the engagement of the ribs 74*d* to the channels 78*d*, respectively, and the engagement of the ribs 78*c* to the channels 80*d*, respectively. However in another exemplary embodiment, any two or more of the ribs 74*d* and 78*c* and the channels 76*d* and 80*d* taper at different angles and the ribs 74*d* still engage the channels 76*d*, respectively, and the ribs 78*c* still engage the channels 80*d*, respectively.

In several exemplary embodiments, the apparatus 10 illustrated in FIGS. 20-31 or any component thereof includes, in whole or in part, one or more embodiments or portions thereof disclosed in U.S. patent application Ser. No. 12/898,444, filed Oct. 5, 2010, the entire disclosure of which is incorporated herein by reference.

A stage tool apparatus for forming an annular body of a fluidic material in an annular region that is partially defined by a preexisting structure has been described that includes a first seat, including: a first annular member defining a first seat passage and a first inside surface adjacent the first seat passage; and a plurality of circumferentially-spaced first channels formed in the first inside surface of the first annular member; and a first blocking element adapted to engage the first seat, the first blocking element including: a first body member defining a first outside surface; and a plurality of circumferentially-spaced first ribs extending along the first outside surface of the first body member; wherein the first blocking element engages the first seat so that the fluidic material is at least partially blocked from flowing through the first seat passage; and wherein the first ribs extend within the first channels, respectively, to resist relative rotation between the first seat and the first blocking element. In an exemplary embodiment, the preexisting structure is a wellbore that traverses a subterranean formation. In an exemplary embodiment, the first blocking element defines a second outside surface and further includes: an annular channel formed in the second outside surface; and an annular sealing element disposed in the annular channel and adapted to sealingly engage the first seat; wherein the first blocking element has: a first axial position, relative to the first seat, in which the first ribs do not extend within the first channels, respectively; and a second axial position, relative to the first seat, in which the first ribs do extend within the first channels, respectively; and wherein the annular sealing element sealing engages the first seat when the first blocking element is in either the first axial position or the second axial position. In an exemplary embodiment, each of the first inside surface and the first outside surface has a frusto-conical shape; wherein the second outside surface has a cylindrical shape; wherein the first seat further defines a second inside surface that extends axially from the first inside surface, the second inside surface having a cylindrical shape and being adjacent the first seat passage; and wherein the annular sealing element sealingly engages the second inside surface of the first seat when the first blocking element is in either the first axial position or the second axial position. In an exemplary embodiment, the stage tool apparatus includes a second seat spaced axially from the first seat, including: a second annular member defining a second seat passage and a third inside surface adjacent the second seat passage; and a plurality of circumferentially-spaced second channels formed in the third inside surface of the second annular member; and a second blocking element adapted to engage the second seat, the second blocking element including: a second body member defining a third outside surface; and a plurality of circumferentially-spaced second ribs extending along the third outside surface of the second body member; wherein the second blocking element engages the second seat so that the fluidic material is at least partially blocked from flowing through the second seat passage; and wherein the second ribs extend within the second channels, respectively, to resist relative rotation between the second seat and the second blocking element. In an exemplary embodiment, each of the first seat, the first body member, the second seat, and the second body member is composed of at least one or more non-metallic materials. In an exemplary embodiment, the first blocking element is a dart and the second blocking element is a plug. In an exemplary embodiment, the stage tool apparatus includes a first tubular member defining a first internal passage, wherein the outside surface of the first tubular member is adapted to partially define the annular region; a second tubular member defining a second internal passage, the second tubular member extending within the first internal passage; wherein the first seat is disposed in the second tubular member; wherein the second tubular member is movable, relative to the first tubular member, from a first position to a second position; wherein the first tubular member includes a flow port that is blocked by the second tubular member when the second tubular member is in the first position; and wherein the flow port is not blocked by the second tubular member when the second tubular member is in the second position. In an exemplary embodiment, the stage tool apparatus includes a third tubular member defining a third internal passage, the third tubular member extending within the first internal passage; wherein the second seat is disposed in the third tubular member; wherein the third tubular member is movable, relative to the first tubular member, from a third position to a fourth position; wherein the flow port is not blocked by the third tubular member when the third tubular member is in the third position; and wherein the flow port is blocked by the third tubular member when the third tubular member is in the fourth position.

A kit for a downhole tool has been described that includes a first seat adapted to be positioned in the downhole tool, the first seat including: a first annular member defining a first seat passage and a first inside surface adjacent the first seat passage; and a plurality of circumferentially-spaced first channels formed in the first inside surface of the first annular member; and a first blocking element adapted to engage the first seat when the first seat is positioned in the downhole tool, the first blocking element including: a first body member defining a first outside surface; and a plurality of circumferentially-spaced first ribs extending along the first outside surface of the first blocking element and adapted to extend within the first channels, respectively; wherein, when the first seat is positioned in the downhole tool, the first blocking element engages the first seat, and the first ribs extend within the first channels, respectively, relative rotation between the first seat and the first blocking element is resisted; and wherein, when the first seat is positioned in the downhole tool and the first blocking element engages the first seat, a fluidic material is at least partially blocked from flowing through the first seat passage. In an exemplary embodiment, the kit includes a second seat adapted to be positioned in the downhole tool and axially spaced from the first seat when the first and second seats are positioned in the downhole tool, the second seat including: a second annular member defining a second seat passage and a second inside surface adjacent the second seat passage; and a plurality of circumferentially-spaced second channels formed in the second inside surface of the second annular member; and a second blocking element adapted to engage the second seat when the second seat is positioned in the downhole tool, the second blocking element including: a second body member defining a second outside surface; and a plurality of circumferentially-spaced second ribs extending along the second outside surface of the second body member and adapted to extend within the second channels, respectively; wherein, when the second seat is positioned in the downhole tool, the second blocking element engages the second seat, and the second ribs extend within the second channels, respectively, relative rotation between the second seat and the second blocking element is resisted; and wherein, when the second seat is positioned in the downhole tool and the second blocking element engages the second seat, the fluidic material is at least partially blocked from flowing through the second seat passage. In an exemplary embodiment, the downhole tool is a stage tool apparatus for forming an annular body of the fluidic material in an annular region that is partially defined by a wellbore that traverses a subterranean formation; wherein the first blocking element is a dart; wherein the second blocking element is a plug; wherein, when the first and second seats are positioned in the stage tool apparatus and the dart engages the first seat, the first seat is adapted to move, relative to the second seat; and wherein, when the first and second seats are positioned in the stage tool apparatus and the plug engages the second seat, the second seat is adapted to move, relative to the first seat. In an exemplary embodiment, each of the first seat, the first body member, the second seat, and the second body member is composed of at least one or more non-metallic materials. In an exemplary embodiment, the first blocking element defines a third outside surface and further includes: an annular channel formed in the third outside surface; and an annular sealing element disposed in the annular channel and adapted to sealingly engage the first seat; wherein the first blocking element has: a first axial position, relative to the first seat, in which the first ribs do not extend within the first channels, respectively; and a second axial position, relative to the first seat, in which the first ribs do extend within the first channels, respectively; and wherein the annular sealing element sealing engages the first seat when the first blocking element is in either the first axial position or the second axial position. In an exemplary embodiment, each of the first inside surface and the first outside surface has a frusto-conical shape; wherein the third outside surface has a cylindrical shape; wherein the first seat further defines a third inside surface that extends axially from the first inside surface, the third inside surface having a cylindrical shape and being adjacent the first seat passage; and wherein the annular sealing element sealingly engages the third inside surface when the first blocking element is in either the first axial position or the second axial position.

A blocking element has been described wherein the blocking element is adapted to engage a seat positioned within a downhole tool, the seat including: an annular member defining a seat passage, a first inside surface having a frusto-conical shape, and a second inside surface extending axially from the first inside surface and having a cylindrical shape, the first and second inside surfaces being adjacent the seat passage, and a plurality of circumferentially-spaced channels formed in the first inside surface of the annular member. The blocking element includes: a body member defining a first outside surface, the first outside surface having a frusto-conical shape; and a plurality of circumferentially-spaced ribs extending along the first outside surface of the body member; wherein the blocking element is adapted to engage the seat so that a fluidic material is at least partially blocked from flowing through the seat passage; and wherein the ribs are adapted to extend within the channels, respectively, to resist relative rotation between the seat and the blocking element. In an exemplary embodiment, the blocking element defines a second outside surface, the second outside surface having a cylindrical shape; wherein the blocking element further includes: an annular channel formed in the second outside surface; and an annular sealing element disposed in the annular channel and adapted to sealingly engage the seat; wherein the blocking element is adapted to have: a first axial position, relative to the seat, in which the ribs do not extend within the channels, respectively; and a second axial position, relative to the seat, in which the ribs do extend within the channels, respectively; and wherein the annular sealing element is adapted to sealingly engage the second inside surface of the seat when the blocking element is in either the first axial position or the second axial position. In an exemplary embodiment, the downhole tool is a stage tool apparatus for forming an annular body of a fluidic material in an annular region that is partially defined by a wellbore that traverses a subterranean formation; wherein the blocking element is a plug and further includes a plurality of wiper elements connected to the body member; and wherein the body member is composed of at least one or more non-metallic materials.

A seat has been described wherein the seat is adapted to be positioned in a downhole tool and engage one of a dart and a plug when positioned in the downhole tool, the one of the dart and the plug including: a body member defining an outside surface, the outside surface having a frusto-conical shape, and a plurality of circumferentially-spaced ribs extending along the outside surface of the body member. The seat includes an annular member defining: a seat passage; a first inside surface adjacent the seat passage, the first inside surface having a frusto-conical shape; a second inside surface extending axially from the first inside surface, the second inside surface having a cylindrical shape and being adjacent the seat passage; and an inwardly-tapered external shoulder spaced radially outwardly from the second inside surface and adapted to engage another shoulder when positioned in the downhole tool; and a plurality of circumferentially-spaced channels formed in the first inside surface of the annular member; wherein the blocking element is adapted to engage the seat so that a fluidic material is at least partially blocked from flowing through the seat passage; and wherein the ribs are adapted to extend within the channels, respectively, to resist relative rotation between the seat and the one of the dart and the plug. In an exemplary embodiment, the downhole tool is a stage tool apparatus for forming an annular body of the fluidic material in an annular region that is partially defined by a wellbore that traverses a subterranean formation; and wherein the seat is composed of at least one or more non-metallic materials.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the above-described embodiments or variations may be combined in whole or in part with any one or more of the other above-described embodiments or variations.

Although several exemplary embodiments have been disclosed in detail above, the embodiments disclosed are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A stage tool apparatus for forming an annular body of a fluidic material in an annular region that is partially defined by a preexisting structure, the stage tool apparatus comprising:

a first seat, comprising:

a first annular member defining a first seat passage and a first inside surface adjacent the first seat passage; and a plurality of circumferentially-spaced first channels formed in the first inside surface of the first annular member;

a first blocking element adapted to engage the first seat, the first blocking element defining a second outside surface, the first blocking element comprising:

a first body member defining a first outside surface;

a plurality of circumferentially-spaced first ribs extending along the first outside surface of the first body member, wherein the ribs are configured to extend within the first channels, respectively, to resist relative rotation between the first seat and the first blocking element;

an annular channel formed in the second outside surface; and an annular scaling element disposed in the annular channel and adapted to sealingly engage the first seat;

a second seat spaced axially from the first seat, comprising:

a second annular member defining a second seat passage and a third inside surface adjacent the second seat passage; and a plurality of circumferentially-spaced second channels formed in the third inside surface of the second annular member; and a second blocking element adapted to engage the second seat, the second blocking element comprising:

a second body member defining a third outside surface; and a plurality of circumferentially-spaced second ribs extending along the third outside surface of the second body member;

wherein the first blocking element is configured to engage the first seat so that the fluidic material is at least partially blocked from flowing through the first seat passage;

wherein the second blocking element engages the second seat so that the fluidic material is at least partially blocked from flowing through the second seat passage at a first pressure and at a second higher pressure the fluidic material flows through the second seat passage;

wherein the second ribs extend within the second channels, respectively, to resist relative rotation between the second seat and the second blocking element; and wherein each of the first seat, the first body member, the second seat, and the second body member is composed at least in part of one or more non-metallic materials, selected from the group of plastics, plastic composites, phenolics, and mixtures thereof;

wherein the first blocking element has:

a first axial position, relative to the first seat, in which the first ribs do not extend substantially within the first channels, respectively; and a second axial position, relative to the first seat, in which the first ribs do extend substantially within the first channels, respectively; and wherein the annular sealing element sealing engages the first seat when the first blocking element is in either the first axial position or the second axial position.

2. The stage tool apparatus of claim 1, wherein the stage tool apparatus is configured for forming an annular body of a fluidic material in an annular region of a preexisting wellbore.

3. The stage tool apparatus of claim 1, wherein each of the first inside surface and the first outside surface has a frustoconical shape and the second outside surface has a cylindrical shape;

wherein the first seat further defines a second inside surface that extends axially from the first inside surface, the second inside surface having a cylindrical shape and being adjacent the first seat passage; and wherein the annular sealing element is adapted to sealingly engage the second inside surface of the first seat when the first blocking element is in either the first axial position or the second axial position.

4. The stage tool apparatus of claim 1, wherein the first blocking element is a dart and the second blocking element is a plug.

5. The stage tool apparatus of claim 4, further comprising:

a first tubular member having an outside surface and defining a first internal passage, the outside surface of the first tubular member adapted to partially define the annular region; and a second tubular member defining a second internal passage, the second tubular member extending within the first internal passage the second tubular member movable relative to the first tubular member from a first position to a second position;

the first seat disposed in the second tubular member;

wherein the first tubular member comprises a flow port that is blocked by the second tubular member when the second tubular member is in the first position; and wherein the flow port is not blocked by the second tubular member when the second tubular member is in the second position.

6. The stage tool apparatus of claim 5, further comprising:

a third tubular member defining a third internal passage, the third tubular member extending within the first internal passage;

wherein the second seat is disposed in the third tubular member, the third tubular member being movable relative to the first tubular member from a third position to a fourth position;

wherein the flow port is not blocked by the third tubular member when the third tubular member is in the third position; and wherein the flow port is blocked by the third tubular member when the third tubular member is in the fourth position.

7. A kit for a downhole tool, the kit comprising:

a first seat adapted to be positioned in the downhole tool, the first seat comprising:

a first annular member defining a first seat passage and a first inside surface adjacent the first seat passage; and said first inside surface including a plurality of circumferentially-spaced first channels; and a first blocking element adapted to engage the first seat when the first seat is positioned in the downhole tool, the first blocking element defining a third outside surface, the first blocking element comprising:

a first body member defining a first outside surface;

a plurality of circumferentially-spaced first ribs extending along the first outside surface of the first blocking element and adapted to extend within the first channels, respectively;

an annular channel formed in the third outside surface; and an annular sealing element disposed in the annular channel and adapted to sealingly engage the first seat;

a second seat adapted to be positioned in the downhole tool and axially spaced from the first seat when the first and second seats are positioned in the downhole tool, the second seat comprising:

a second annular member defining a second seat passage and a second inside surface adjacent the second seat passage; and a plurality of circumferentially-spaced second channels formed in the second inside surface of the second annular member; and a second blocking element adapted to engage the second seat when the second seat is positioned in the downhole tool, the second blocking element comprising:

a second body member defining a second outside surface; and a plurality of circumferentially-spaced second ribs extending along the second outside surface of the second body member and adapted to extend within the second channels, respectively;

wherein, when the first seat is positioned in the downhole tool, the first blocking element engages the first seat, and the first ribs extend within the first channels, respectively, relative rotation between the first seat and the first blocking element is resisted;

wherein, when the first seat is positioned in the downhole tool and the first blocking element engages the first seat, a fluidic material is at least partially blocked from flowing through the first seat passage;

wherein, when the second seat is positioned in the downhole tool, the second blocking element engages the second seat, and the second ribs extend within the second channels, respectively, relative rotation between the second seat and the second blocking element is resisted;

wherein, when the second seat is positioned in the downhole tool and the second blocking element engages the second seat, the fluidic material is at least partially blocked from flowing through the second seat passage at the first pressure, and at a second higher pressure the fluidic material flows through the second seat passage; and wherein each of the first seat, the first body member, the second seat, and the second body member is composed of at least one or more nonmetallic materials, selected from the group of plastics, plastic composites, phenolics, and mixtures thereof;

wherein the first blocking element has:

a first axial position, relative to the first seat, in which the first ribs do not extend within the first channels, respectively; and a second axial position, relative to the first seat, in which the first ribs do extend within the first channels, respectively; and wherein the annular sealing element sealing engages the first seat when the first blocking element is in either the first axial position or the second axial position.

8. The kit of claim 7, wherein the downhole tool is a stage tool apparatus for forming an annular body of the fluidic material in an annular region that is partially defined by a wellbore that traverses a subterranean formation;

wherein the first blocking element is a dart;

wherein the second blocking element is a plug;

wherein, when the first and second seats are positioned in the stage tool apparatus and the dart engages the first seat, the first seat is adapted to move, relative to the second seat; and wherein, when the first and second seats are positioned in the stage tool apparatus and the plug engages the second seat, the second seat is adapted to move, relative to the first seat.

9. The kit of claim 7, wherein each of the first inside surface and the first outside surface has a frusto-conical shape;

wherein the third outside surface has a cylindrical shape;

wherein the first seat further defines a third inside surface that extends axially from the first inside surface, the third inside surface having a cylindrical shape and being adjacent the first seat passage; and wherein the annular sealing element sealingly engages the third inside surface when the first blocking element is in either the first axial position or the second axial position.

10. A blocking element adapted to engage a seat positioned within a downhole tool, the seat comprising:

an annular member defining a seat passage, a first inside surface having a frusto-conical shape, and a second inside surface extending axially from the first inside surface and having a cylindrical shape, the first and second inside surfaces being adjacent the seat passage, and the first inside surface of the annular member defining a plurality of circumferentially-spaced channels, the blocking element defining a second outside surface, the second outside surface having a cylindrical shape, the blocking element comprising:

a body member defining a first outside surface, the first outside surface having a frusto-conical shape;

a plurality of circumferentially-spaced ribs extending along the first outside surface of the body member;

an annular channel formed in the second outside surface; and an annular sealing element disposed in the annular channel and adapted to sealingly engage the seat;

wherein the blocking element is adapted to engage the seat so that a fluidic material is at least partially blocked from flowing through the seat passage;

wherein the ribs are adapted to extend within the channels, respectively, to resist relative rotation between the seat and the blocking element;

wherein the downhole tool is a stage tool apparatus for forming an annular body of a fluidic material in an annular region that is partially defined by a wellbore that traverses a subterranean formation;

wherein the blocking element is a plug and further comprises a plurality of wiper elements connected to the body member; and wherein the body member is composed of at least one or more non-metallic materials, selected from the group of plastics, plastic composites, phenolics, and mixtures thereof;

wherein the blocking element is adapted to have:

a first axial position, relative to the seat, in which the ribs do not extend within the channels, respectively; and a second axial position, relative to the seat, in which the ribs do extend within the channels, respectively;

wherein the annular sealing element is adapted to sealingly engage the second inside surface of the seat when the blocking element is in either the first axial position or the second axial position.

11. A seat adapted to be positioned in a downhole tool and engage one of a dart and a plug when positioned in the downhole tool, the one of the dart and the plug being a blocking element comprising:

a body member defining an outside surface, the outside surface having a frusto-conical shape, and the outside surface of the body member including a plurality of circumferentially spaced ribs, the seat comprising:

an annular member defining:

a seat passage;

a first inside surface adjacent the seat passage, the first inside surface having a frusto-conical shape;

a second inside surface extending axially from the first inside surface, the second inside surface having a cylindrical shape and being adjacent the seat passage; and an inwardly-tapered external shoulder spaced radially outwardly from the second inside surface and adapted to engage another shoulder when positioned in the downhole tool;

the first inside surface of the annular member including a plurality of circumferentially spaced channels;

wherein the blocking element is adapted to engage the seat so that a fluidic material is at least partially blocked from flowing through the seat passage;

wherein the ribs are adapted to extend within the channels, respectively, to resist relative rotation between the seat and at least one of the dart and the plug; and wherein the downhole tool is a stage tool apparatus for forming an annular body of the fluidic material in an annular region that is partially defined by a wellbore that traverses a subterranean formation; and wherein the seat is composed in part of at least one or more non-metallic materials, selected from the group of plastics, plastic composites, phenolics, and mixtures thereof;

wherein the second inside surface of the seat is configured to be sealingly engaged by an annular sealing element disposed in an annular channel of the blocking element when the blocking element is in either a first axial position, relative to the seat, in which the ribs do not extend within the channels, respectively, or a second axial position, relative to the seat, in which the ribs do extend within the channels, respectively.

* * * * *